United States Patent [19]

Vrzalik

[11] Patent Number: 5,005,240

[45] Date of Patent: Apr. 9, 1991

[54] PATIENT SUPPORT APPARATUS

[75] Inventor: John H. Vrzalik, San Antonio, Tex.

[73] Assignee: Kinetics Concepts, Inc., San Antonio, Tex.

[21] Appl. No.: 251,948

[22] Filed: Sep. 29, 1988

Related U.S. Application Data

[63] Continuation of Ser. No. 124,382, Nov. 20, 1987, abandoned, which is a continuation of Ser. No. 784,875, Oct. 4, 1985, abandoned, which is a continuation-in-part of Ser. No. 683,153, Dec. 17, 1984, abandoned.

[51] Int. Cl.[5] ..... A61G 7/00

[52] U.S. Cl. ..... 5/453; 5/455; 137/883; 137/96.17

[58] Field of Search ..... 5/421, 423, 448, 449, 5/453, 458, 468, 469; 137/341, 596.17, 625.44, 88321 1

[56] References Cited

U.S. PATENT DOCUMENTS

| | | | |
|---|---|---|---|
| 1,936,960 | 11/1933 | Bowman | 5/469 |
| 2,998,817 | 9/1961 | Armstrong . | |
| 3,149,348 | 9/1964 | Hillenbrand et al. . | |
| 3,477,071 | 11/1969 | Emerson . | |
| 3,480,040 | 11/1969 | Erickson | 137/883 |
| 3,485,240 | 12/1969 | Fountain . | |
| 3,492,988 | 2/1970 | de Mare . | |
| 3,653,083 | 4/1972 | Lapidus . | |
| 3,671,151 | 6/1972 | Duke et al. | 137/883 X |
| 3,821,821 | 7/1974 | Burst et al. . | |
| 3,822,425 | 7/1974 | Scales . | |
| 3,865,500 | 6/1976 | Stein Jr. . | |
| 3,879,776 | 4/1975 | Solen | 5/458 |
| 3,909,858 | 10/1975 | Ducker . | |
| 3,935,604 | 2/1976 | Collins . | |
| 3,949,438 | 4/1976 | Scales . | |
| 3,958,283 | 5/1976 | Adams et al. . | |
| 4,025,972 | 5/1977 | Adams et al. . | |
| 4,097,939 | 7/1978 | Peck et al. . | |
| 4,097,940 | 7/1978 | Tekulve et al. . | |
| 4,279,044 | 7/1981 | Douglas . | |
| 4,488,322 | 12/1984 | Hunt et al. . | |
| 4,542,547 | 9/1985 | Sato . | |
| 4,559,655 | 12/1985 | Peck . | |
| 4,564,965 | 1/1986 | Goodwin . | |
| 4,617,690 | 10/1986 | Grebe | 5/455 |
| 4,638,519 | 1/1987 | Hess | 5/455 |
| 4,650,159 | 3/1987 | Shimamura | 137/596.17 X |
| 4,686,722 | 8/1987 | Swart | 5/453 |

FOREIGN PATENT DOCUMENTS

| | | |
|---|---|---|
| 2004889 | 10/1984 | European Pat. Off. . |
| 1273342 | 5/1972 | United Kingdom . |
| 1341325 | 12/1973 | United Kingdom . |
| 1442994 | 7/1976 | United Kingdom . |
| 1474018 | 5/1977 | United Kingdom . |
| 1483045 | 8/1977 | United Kingdom . |
| 1545806 | 5/1979 | United Kingdom . |
| 1601808 | 11/1981 | United Kingdom . |
| 2141333A | 12/1984 | United Kingdom . |

OTHER PUBLICATIONS

Schaub, U. W., "The NRC Hospital Air Bed Program," 3 Medical Instrumentation 1 (1976).

Gilmore, A., "National Research Council Spends $6

(List continued on next page.)

*Primary Examiner*—Michael F. Trettel

*Attorney, Agent, or Firm*—Cox & Smith

[57] ABSTRACT

A low air loss bed having an integral source of air mounted to the frame thereof. Sets of air bags are mounted on the frame, each set of air bags corresponding to a portion of the body of the patient to be supported on the bed. Separate gas manifolds are provided, each of which connects a single set of air bags to the gas source. Individuallv controlled valves are used to adjust the amount of air which flows to the gas manifolds and on into the air bags. Also, means are provided operable to selectively route a flow of additional air to the gas manifold which supplies air to the air bags which support the heavier portions of the patient. A low air loss air bag is provided, as is apparatus for adjusting the amount of air supplied to each set of air bags and for controlling the temperature of the air delivered. Also provided is a means for simultaneously fully inflating all the air bags and means for simultaneously deflating all the air bags.

39 Claims, 13 Drawing Sheets

OTHER PUBLICATIONS

Million a Year on Health Related Research," 120 CMA Journal 1172 (1979).

Kenedi, R. M., et al., Eds., Bed Sore Biomechanics, London: The MacMillan Press, Ltd. (1976).

Scales, J. T., et al., "The Prevention and Treatment of Pressure Sores Using Air-Supported Systems," 12 Paraplegia 118 (1974).

Leeder, Cheryl J., "Use of the Low Air Loss Bed System in Treatment of Burns Patients," 13 Scand. J. Plast. Reconstr. Surg. 159 (1979).

Greenfield, Ruth A., "The Low Air Loss Bed System," Nursing Times Sep. 21, 1972, pp. 1192-1194 (1972).

Coombs, R. M., "Supporting Patients on Air: An Answer to Pressure Sores," Nursing Mirror and Medwives Journal, Approx. Mar. 24, 1976.

Brochure Entitled "Clinitron-A New Therapy"; Support Systems International (France, U.S.) (Undated).

Flyer Entitled "Data Sheet No. 11-Standard Version: Model 101"; Support Systems International (France) (Undated).

Flyer Entitled "Cairbed"; Osmoco Laboratories (Canada) (Undated).

Brochure Entitled "The Low Air Loss Bed System-A Controlled Air System for Patient Support"; Mediscus Products, Ltd. (England) (Undated).

Brochure Entitled "Mediscus Air Bed Mk V"; Mediscus Products, Ltd. (England).

Engineers Service Manual: Mediscus Air Bed Mk V (Undated).

Nurse's Instruction Manual: Mediscus Air Bed Mk V (Undated).

Brochure Entitled "Mediscus Air Bed Mk VA"; Mediscus Products, Ltd. (England) (Undated).

Brochure Entitled "The Mediscus Mark V-A Pressure Treatment System . . ."; Mediscus Products, Inc. (U.S.) (Approx. 12/84).

Brochure Entitled "Mark V-A Technical Information"; Mediscus Products, Inc. (U.S.) (Approx. 12/84).

Engineers Service Manual: Mediscus Air Bed Mk VA (Undated).

Nurses Manual: Mediscus Air Bed Mk. 5A (Undated).

Brochure Entitled "The Mediscus HOME-CARE Versatile Air Bed"; Mediscus Products, Ltd. (England) (Undated).

Engineers Service Manual: Mediscus Homecare Air Bed (Undated).

Brochure Entitled "The Mediscus Minor"; Mediscus Products, Ltd.

Nurses Instruction Manual and Engineers Manual: Mediscus Minor Air Bed.

PATIENT SUPPORT APPARATUS

BACKGROUND OF THE INVENTION

The present application is a continuation of application Ser. No. 124,382 filed on Nov. 30, 1987, now abandoned, which is a continuation of application Ser. No. 784,875 filed Oct. 4, 1985, now abandoned, which is a continuation-in-part application of my co-pending application Ser. No. 683,153, filed on Dec. 17, 1984 now abandoned.

The present invention relates to a low air loss bed. More particularly, it relates to a bed having gas permeable air bags mounted thereto and a gas source which is mounted in the frame of the bed to supply a flow of gas to the air bags without the necessity for a separate unit having a blower and controls to supply the air bags.

Such a bed can be used to advantage for the prevention of bed sores in bedridden patients. Other devices are known which are directed to the same object, but these devices suffer from several problems. In particular, U.S. Pat. No. 3,822,425 discloses an air mattress consisting of a number of cells or bags each having a surface which supports the patient formed from a material which is gas permeable but is non-permeable to liquids and solids. It also discloses an air supply for inflating the cells to the required pressure and outlets or exhaust ports to allow the escape of air. The stated purpose of the outlets is to remove condensed vapor for the cells or bags. The outlets on that mattress may be fitted with valves to regulate the air pressure in the cells as opposed to regulating the air pressure in the cells by controlling the amount of air flowing into the cells. However, the air bed which is described in that patent and which is currently being marketed under that patent is believed to have certain disadvantages and limitations.

For example, that bed has a single air intake coupler, located directly and centrally underneath the air mattress, for connection of the source of air. Access to this connection is difficult since one must be on their back to reach it. The location of the connection underneath the mattress creates a limitation in the frame construction because the air hose must pass between the bed frame members. The source of air to which the air hose is connected is a blower or air pump mounted in a remote cabinet which, because it must be portable, is mounted on casters There are many times in actual use when the cabinet must be moved in order to wheel other equipment, such as I.V. stands, around it or for access to the patient. However, relocation of this blower unit by any significant distance requires disconnection of the air hose from the frame (inconvenient because of the location up underneath the frame) or the pendent control in order to avoid wrapping the air hose around the bed frame members. Of course, disconnection of the air hose results in the loss of air pressure in the air mattress, which is even less desirable.

Another disadvantage with that type of bed relates to the monitoring of patient body weight. When charting fluid retention and other parameters, the patient's body weight is monitored continuously. When a patient is bedridden, the only way to monitor body weight is to weigh both bed and patient, then subtract the weight of the bed. But when a portion of the bed hangs off of the bed, as the air hose does, and when the changes in weight being monitored are measured in ounces, it is very difficult to accurately chart the changes in body weight when the patient is on such a bed.

Further, the bed disclosed by that patent is limited in that only a finite amount of air can be forced or pumped into the air mattress. By eliminating the outlets described in that patent entirely, the air pressure in the bags can at least be maintained at that point which represents the maximum output of the source of gas. In the case of the bed described in that patent, if it is necessary to further increase the pressure in the air bags while the outlets are being used for their stated purpose, the only way to do so is to install a larger capacity blower in the cabinet. High air pressures may be necessary, for instance, to support obese patients. A larger capacity blower generally requires more power consumption and a higher capacity circuit which may not be readily available. Also, the larger the blower, the more noise it creates which is not desirable.

The limitations and disadvantages which characterize other previous attempts to solve the problem of preventing bed sores in bedridden patients are well characterized in English Pat. No. 1,474,018 and U.S. Pat. No. 4,425,676.

The present invention represents an improved apparatus over the prior art. It is characterized by a number of advantages which increase its utility over the prior art devices, including its flexibility of use, its ability to maintain high air pressures, the ability to quickly and easily replace one or more of the air bags while the apparatus is in operation, and the ease of adjustment of the air pressure in the air bags.

It is, therefore, an object of the present invention to provide a low air loss bed comprising a frame, a source of gas mounted on the frame, a plurality of sets of gas permeable air bags mounted to the frame, each set of air bags corresponding to a portion of a patient to be supported on the bed, a plurality of gas manifolds communicating with the gas source and with one of said sets of air bags, and means for separately controlling the amount of gas which flows from the gas source to each of said sets of air bags, thereby varying the amount of support provided for each portion of the patient.

It is a further object of the present invention to provide an air bed, the air pressure of which can be quickly and conveniently set to support a patient of known body weight, by simply setting the valves regulating the amount of air flowing from the air source.

Another object of the present invention is to provide a means for selectively routing an additional flow of gas from the gas source directly to the gas manifold supplying the set of air bags supporting the heavier portions of the patient without routing the flow through the gas flow controlling means.

Another object of the present invention is to provide a low air loss bed which is self-contained in that it requires no outboard gas source and is, therefore, more compact and convenient to use.

Another object of the present invention is to provide a low air loss bed upon which a patient may be maintained and which allows accurate monitoring of patient body weight.

Another object of the present invention is to provide a low air loss bed having an integral gas source which can be raised, lowered or tipped, and which allows the raising or lowering of a portion of the bed.

Another object of the present invention is to provide a low air loss gas permeable air bag which is comprised of bottom and side walls of a relatively gas impermeable material and a top of gas permeable material, thereby decreasing the amount of gas which escapes through the air bag without limiting its function.

Another object of the present invention is to provide an air bag with a single opening which can be quickly and easily detached from an air bed to allow the easy replacement of the air bag, even while the bed is in operation.

Other objects and advantages will be apparent to those of skill in the art from the following disclosure.

SUMMARY OF THE INVENTION

These objects and advantages are accomplished in the present invention by providing a frame with a source of gas mounted thereon. A plurality of sets of gas permeable air bags are mounted on the frame, each set of air bags corresponding to a portion of a patient to be supported in prone position on the bed. Each of a plurality of separate gas manifolds communicates with the gas source and one set of the sets of air bags. Also provided is a means for separately changing the amount of gas delivered by the gas source to each of the gas manifolds, thereby varying the amount of support provided for each portion of the patient. Also provided is a means operable to selectively route a flow of gas from the gas source to the set of air bags supporting the heavier portions of the patient without passing through the gas flow changing means when the weight of the prone patient is concentrated on that set of air bags. Releasable connectors at the side of each air bag secure each air bag to the bed frame and connect the air bag to its respective gas manifold, allowing for quick removal of the bag. The air bag may be constructed of a first material which is relatively impermeable to gas and a second material which is gas permeable, the sides and bottom of the bags being constructed of the first material, and the top of each bag being constructed of the second material. The bottom of the air bag is provided with a single inlet which connects the interior of the air bag with a gas source, the gas from the gas source escaping from the interior of said air bag mainly from the top. The air bag is also provided with means operable to retain the connection between the gas source and the interior of the air bag.

Also provided is a low air loss bed comprising a bed frame having a source of gas and a plurality of sets of gas permeable air bags mounted thereto. Separate gas manifolds communicate with the interior of the air bags on one set of the sets of air bags and the gas source. An air control box is mounted to the bed frame and interposed in the flow of air from the gas source to the gas manifolds, and is provided with individually adjustable valves for changing the amount of gas delivered to each of the gas manifolds. The air control box is also provided with means operable to selectively open all of the valves to the atmosphere, allowing the gas to escape from each of the sets of air bags, to collapse the air bags with the result that the patient is supported by the frame of the air bed rather than the air bags.

Also provided with a low air loss bed having a bed frame and a plurality of sets of air bags mounted thereto with a plurality of gas manifolds communicating separately with the gas source and the interior of the air bags. An air control box is mounted to the bed frame in fluid connection with the gas source and the gas manifolds, and is provided with valves which are individually adjustable to change the amount of the flow from the gas source through the air control box to each of the gas manifolds. The air control box is also provided with means operable to simultaneously fully open the valves to cause the air bags to fully inflate.

Also provided is a low air loss bed having a frame and a plurality of sets of air bags mounted thereto with a plurality of gas manifolds communicating separately with the gas source and the interior of the air bags. An air control box is also mounted on the frame, the interior of the air control box communicating with the gas manifolds and the gas source and having means therein for separately changing the amount of gas delivered by the gas source to each of the gas manifolds. The air control box is also provided with means operable to heat the gas flowing through the air control box and with means operable to switch the heating means on and off in response to the temperature in the air control box. Also provided is means having a sensor in one of the gas manifolds which is operable to selectively control the heating means, the means operable to switch the heating means on and off in response to the temperature in the air control box being operable at a predetermined temperature.

DETAILED DESCRIPTION OF THE PREFERRED EMBODIMENTS

Figure 1:
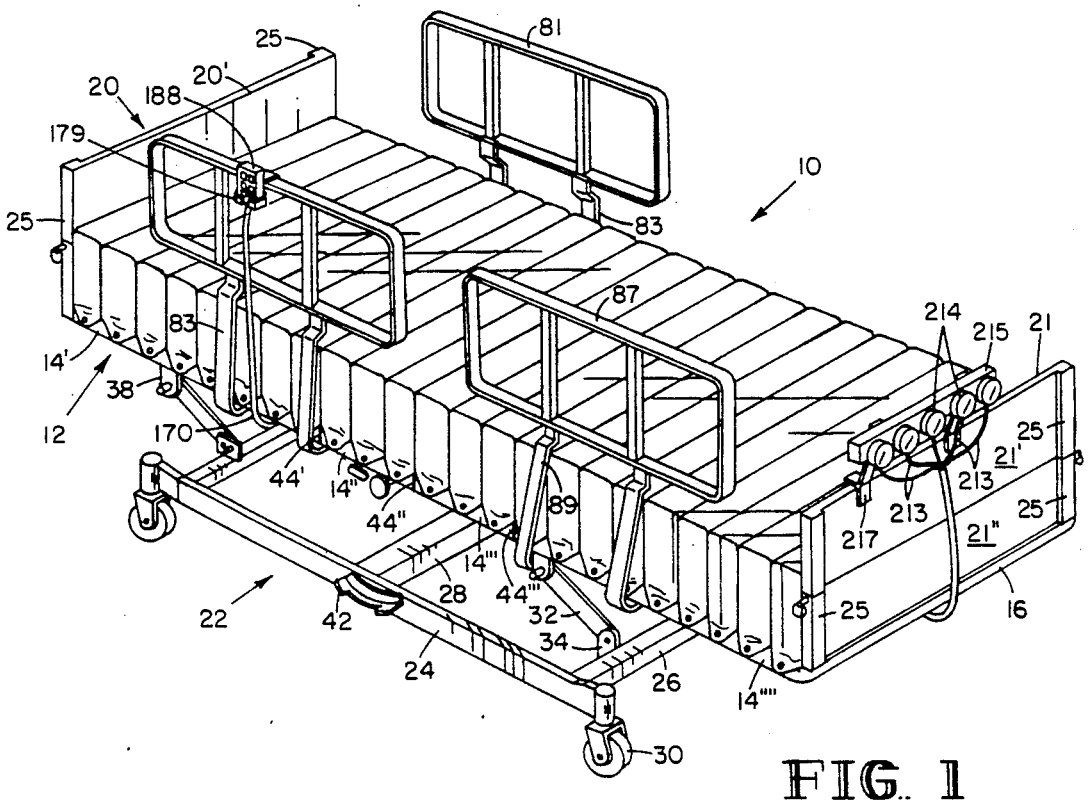
FIG. 1 is a perspective view of a presently preferred embodiment of the low air loss bed of the present invention.

Referring to FIG. 1, there is shown a bed 10 including a frame 12. The frame 12 is comprised of a plurality of sections 14', 14'', 14''' and 14'''', hinged at the points 44', 44'' and 44''', and end members 16. Cross-members 18 (FIGS. 6, 7 and 17) and braces 19 (FIGS. 7 and 17) are provided for additional rigidity. The frame 12 is provided with headboard 20 at one end and a foot board 21 at the other end. The respective head 20 and foot 21 boards are actually constructed of two boards, 20' and 20'', and 21' and 21'', respectively, which are stacked one on top of the other by the vertical slats 25 on which the boards 20', 20'', 21' and 21'' are mounted.

A separate sub-frame, indicated generally at reference numeral 27 in FIGS. 2, 6, 7 and 17, is mounted on a base 22 comprised of longitudinal beams 24, cross-beams 26 and cross-member 28 by means of a vertical height adjustment mechanism as will be described. The base 22 is mounted on casters 30 at the corners of the base 22. A foot pedal 42 is provided for braking and steering the casters 30.

Sub-frame 27 is comprised of cross beams 29, hoop brace 35, and longitudinal beams 31 (see FIGS. 2, 6, 7 and 17). Sub-frame 27 is provided at the corners with uprights 33, having tabs 33' thereon, for mounting of IV bottles and other equipment. The sub-frame 27 may be raised and lowered relative to the base 22 by means of a vertical height adjustment mechanism, not all of the details of which are shown. Height is adjusted by rotation of axle 36 under influence of a power screw, hidden from view in FIGS. 2 and 7 by drive tunnel beam 37, which is powered by a motor which is also hidden from view. Axle 36 is journaled in the ears 38 which are mounted to the longitudinal beams 31 of sub-frame 27. Power is transferred from the power screw to axle 36 by means of eccentric levers 39, the axle 40 of which is journaled in drive tunnel beam 37. Sub-frame 27 rises on levers 32 which are pivotally mounted to the cross-beams of base 22 by members 34.

Figure 6:
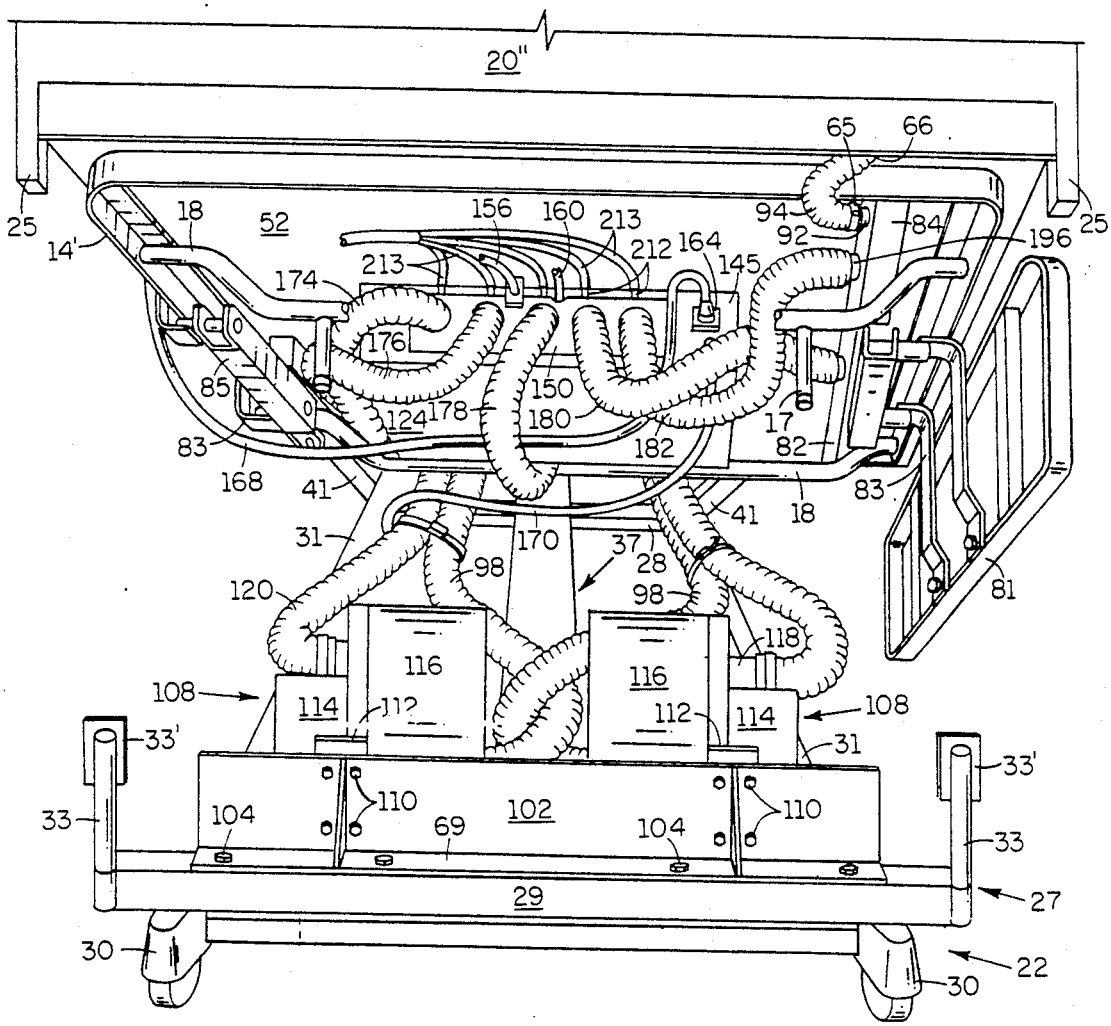
FIG. 6 is an end view of the low air loss bed of FIG. 1 with the head portion raised to show the construction of the frame and the components mounted thereto.
Figure 7:
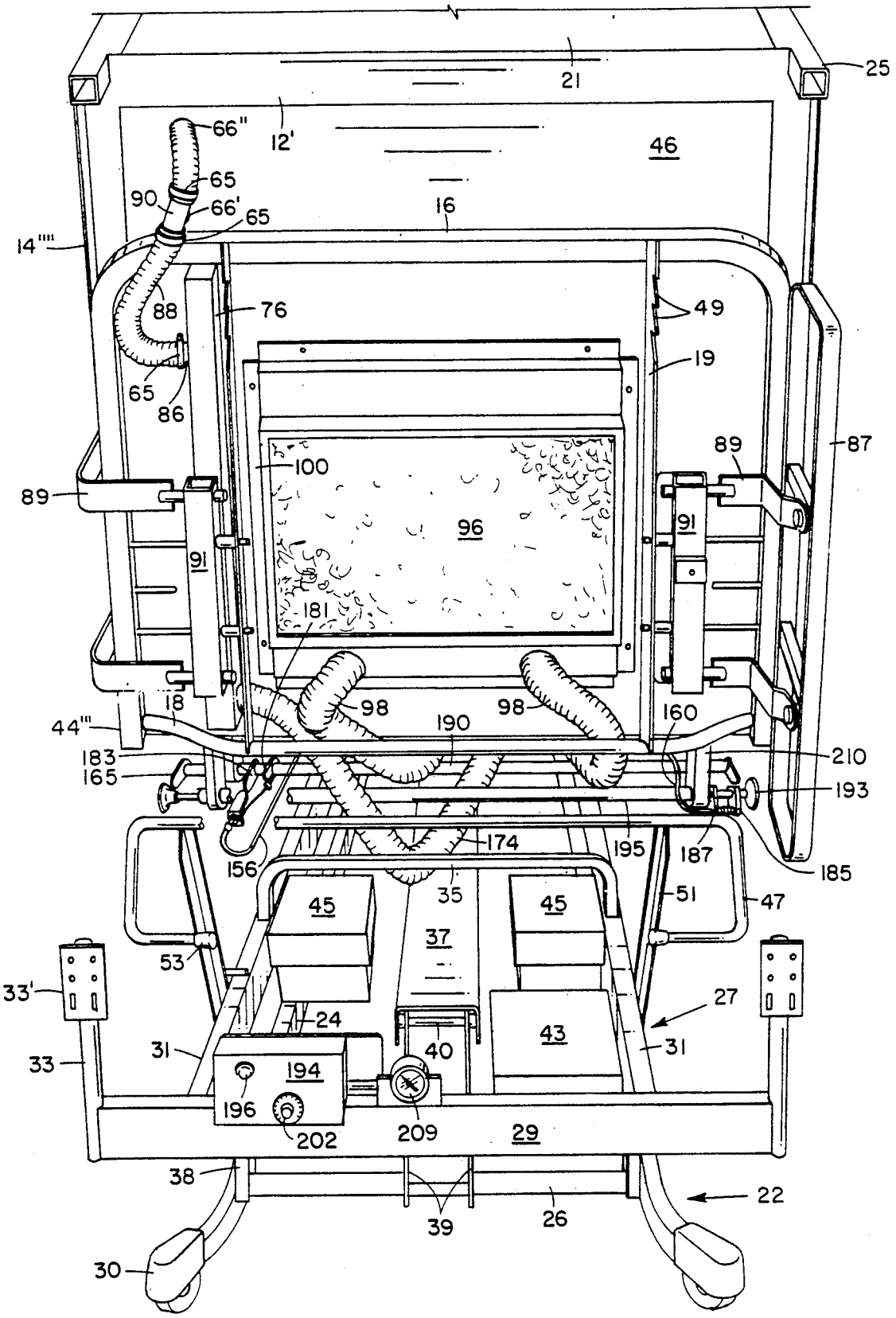
FIG. 7 is an end view of the low air loss bed of FIG. 1 with the foot portion raised to show the construction of the frame and the components mounted thereto.
Figure 17:
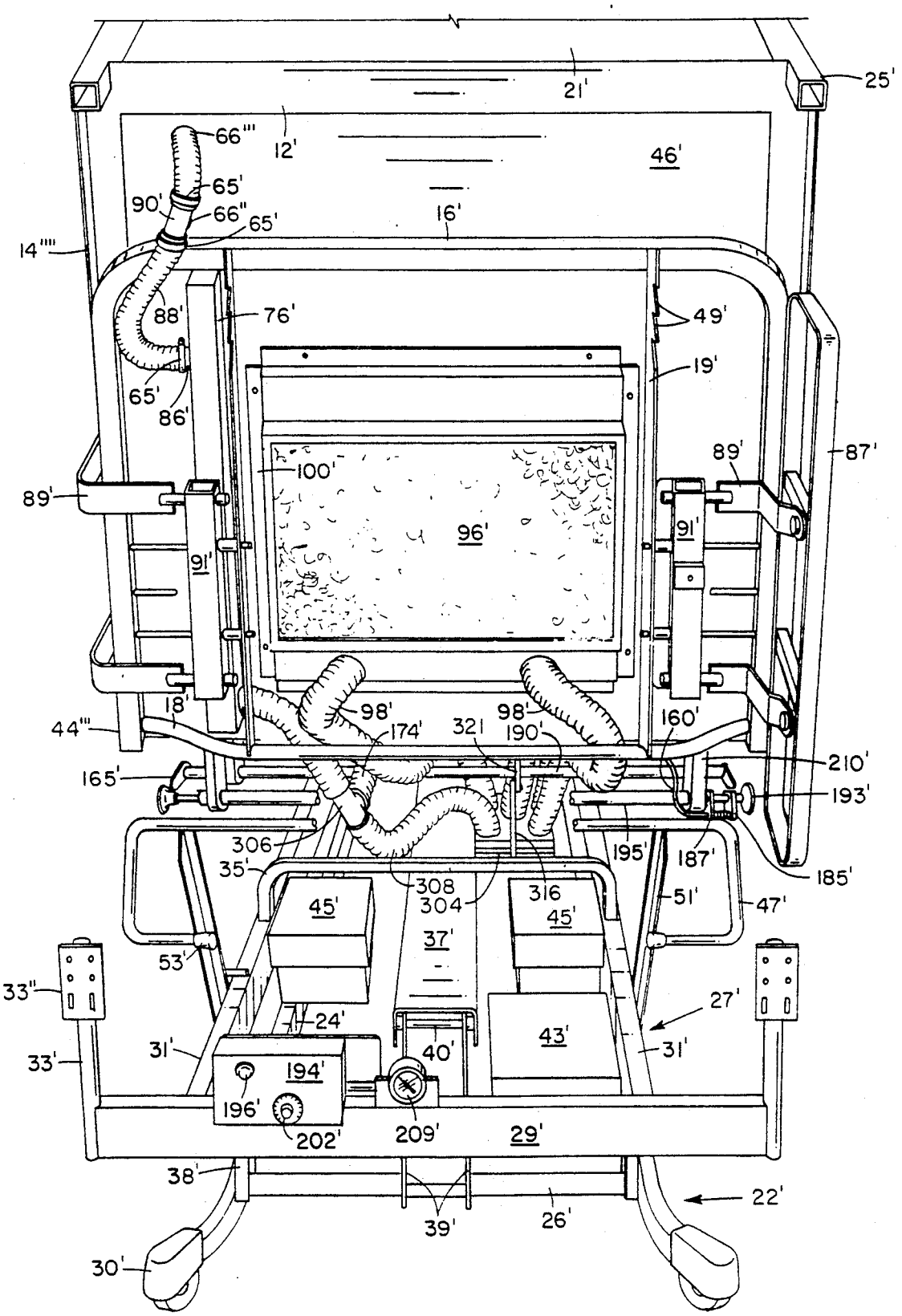
FIG. 17 is an end view similar to FIG. 7 showing an alternative construction of the low air loss bed of the present invention.
Figure 18:
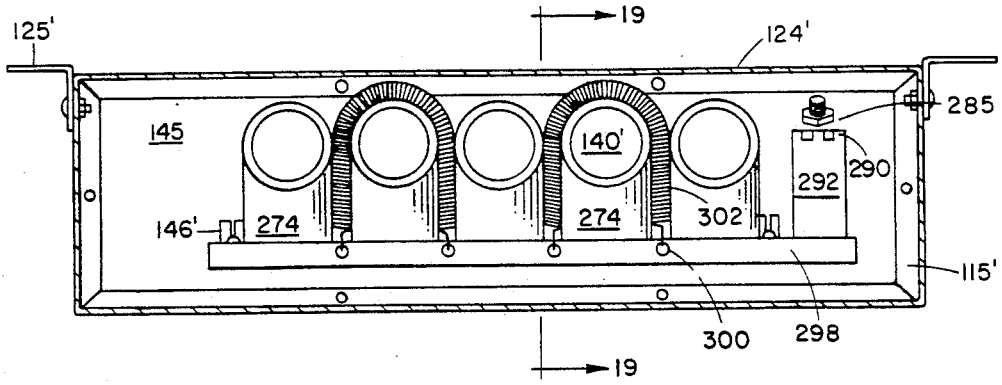
FIG. 18 is a back view of the manifold assembly removed from the air box of FIG. 16.

The section 14'' of frame 12 is mounted to the longitudinal beams 31 of sub-frame 27 by support members 41 (see FIG. 6). The section 14' of frame 12, with the head baseboard 52 thereon, and the section 14''''of frame 12, with foot baseboard 46 thereon, pivot upwardly from the horizontal at the hinges 44' amd 44'''', respectively. The details of this pivoting are known in the art and are not shown for purposes of clarity, although the motors are located within the boxes shown at 45 and the circuitry for those functions is contained within box 43 (FIGS. 7 and 17). Supports 17 are provided on the cross member 18 under head baseboard 52 which rest on the longitudinal beams 31 of sub-frame 27 when head baseboard 52 is horizontal. When foot baseboard 46 is raised, cross-bar 47 rises with it by means of the pivoting connection created by cross-bar 47 and the notches 49 in brace 19 (cross-bar 47 is shown detached from braces 19 in FIG. 7 for purposes of clarity). The sets of notches 49 provide a means of adjusting the height to which foot baseboard 46 can be raised, foot baseboard 46 pivoting upwardly on brackets 51 which are pivotally mounted to the longitudinal beams 31 of sub-frame 27. The tips 53 of cross-bar 47 rest on longitudinal beam 31 when foot baseboard 46 is lowered to the horizontal.

Side rails 81 are mounted to brackets 83 (see FIG. 6) which are pivotally mounted to the mounting brackets 85 mounted on the underside of head baseboard 52. Side rails 87 are mounted to brackets 89 (see FIG. 7), and brackets 89 are pivotally mounted to the mounting brackets 91. Mounting brackets 91 are affixed to the braces 19 on the underside of foot baseboard 46.

Figure 11:
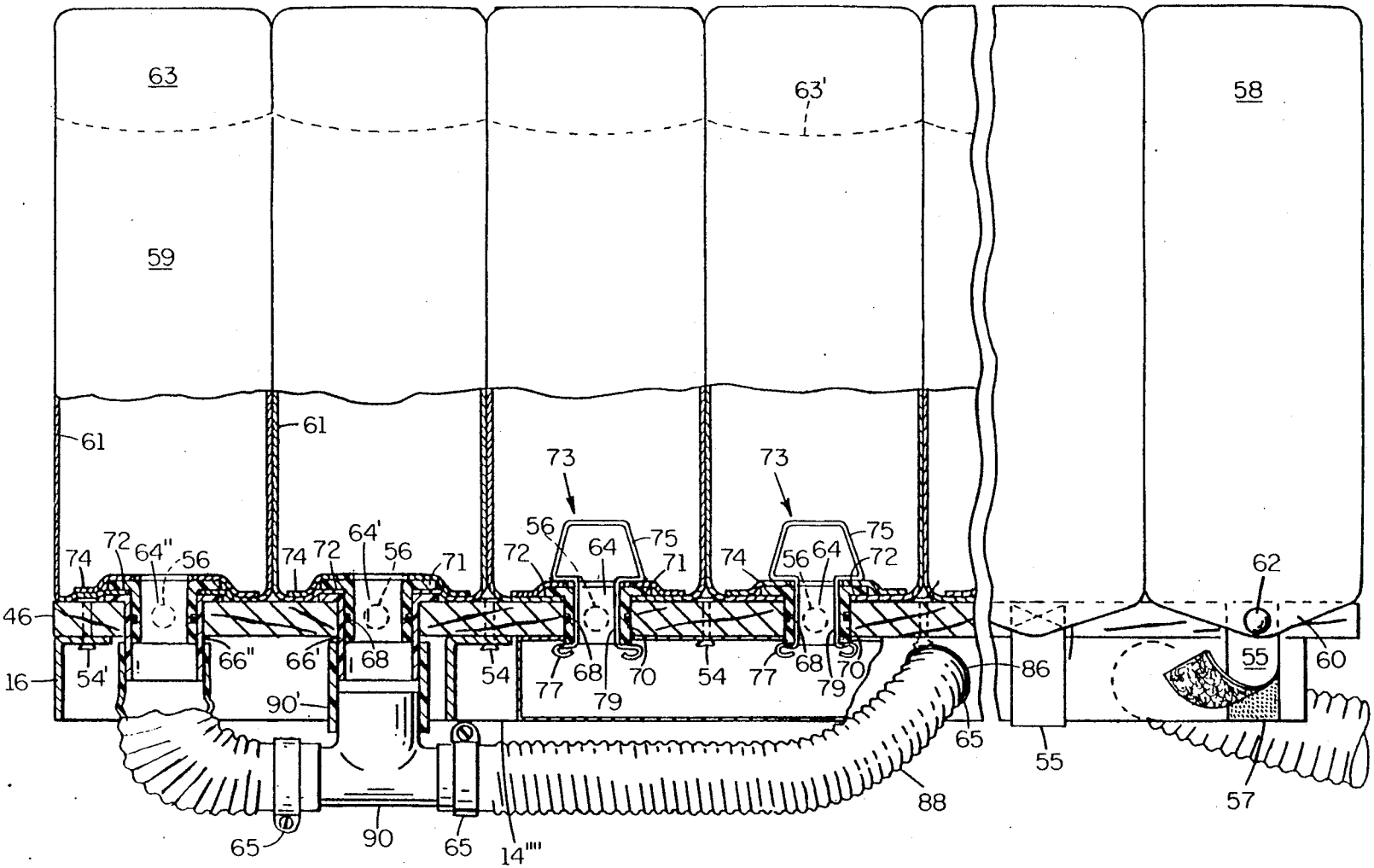
FIG. 11 is a partial longitudinal section taken through the foot baseboard of the low air loss bed of FIG. 1.
Figure 12:
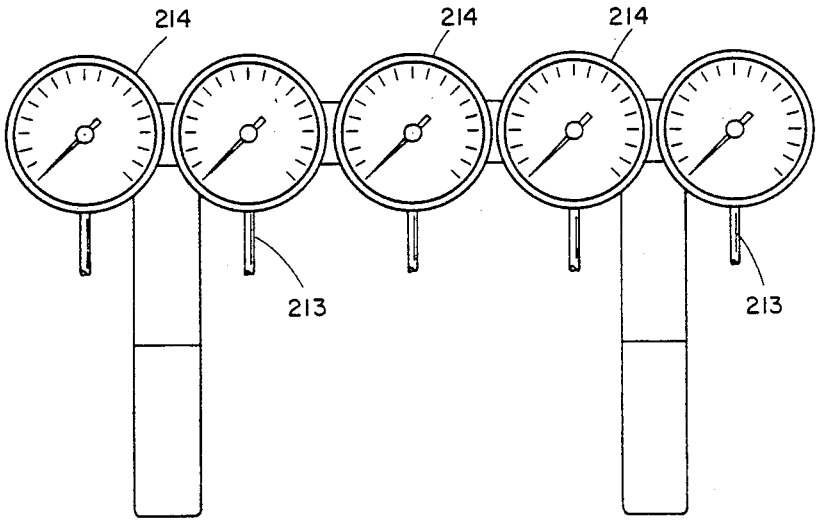
FIG. 12 is a plan view of the bracket and air gauges of the low air loss bed of FIG. 1.
Figure 13:
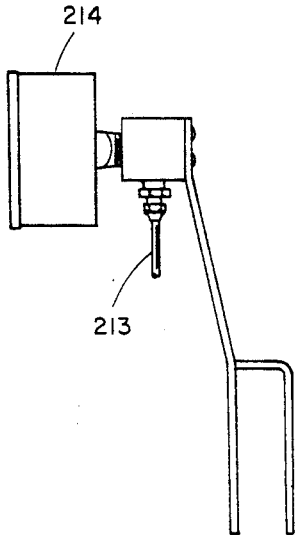
FIG. 13 is an end view of the bracket and air gauges of FIG. 12.

The frame 12 is provided with a feet baseboard 46, a leg baseboard 48, a seat baseboard 50 and a head baseboard 52 (shown in shadow lines in FIG. 3), each being mounted to the corresponding section 14', 14'', 14''' and 14'''' of the frame 12 by means of rivets 54 (see FIG. 11). The baseboards 46–52 are provided with male snaps 56 (FIG. 11) along their edges. A plurality of air bags 58 are provided with flaps 60, each of which is supplied with female snaps 62 which mate with male snaps 56. Flaps 60 may be provided with a strip of VELCRO tape 55, and the edges of baseboards 46–52 may be provided with a complementary strip of VELCRO hooks 57, to secure each air bag 58 in place. Alternatively, flap 60 and baseboards 46–52 may be provided with both VELCRO and snap fastening means. The baseboards 46–52 are also provided with a plurality of holes 64. The holes 64' and 64'' at the extreme end of the feet baseboard 46 are provided with receptacles 66' and 66''. The hole 64''' at the extreme end of the head baseboard 52 is also provided with a receptacle 66'''.

Figure 2:
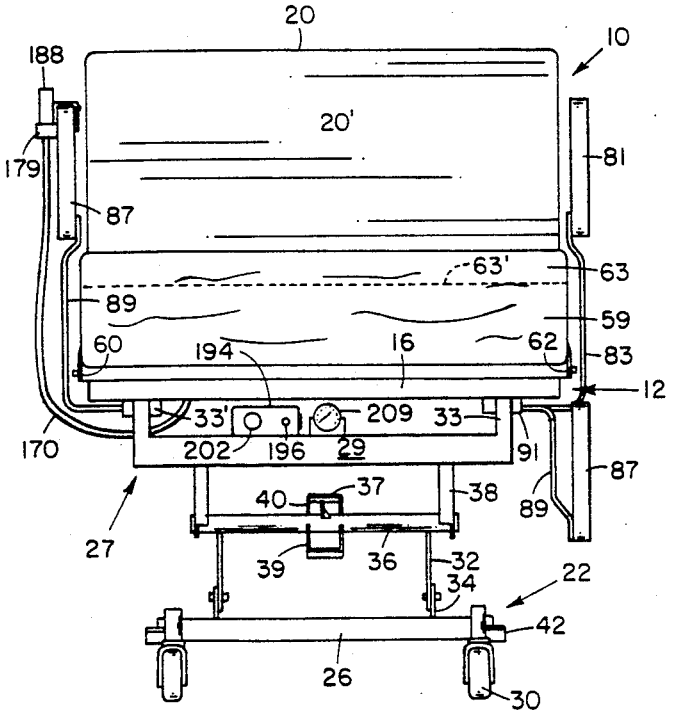
FIG. 2 is an end view of the low air loss bed of FIG. 1 with the footboard removed and some details not shown for purposes of clarity.
Figure 5:
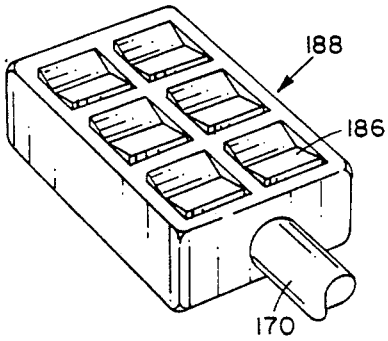
FIG. 5 is a perspective view of the pendent control of the low air loss bed of FIG. 1.

The air bags 58 are substantially rectangular in shape, and are constructed of a coated fabric or similar material through which gas, including water vapor, can move, but which water and other liquids will not penetrate. The fabric sold under the trademark "GORE-TEX" is one such suitable material. The air bags 58 may be constructed in a "low air loss" conformation. The low air loss air bag shown at reference numeral 59 in FIGS. 2 and 11 is a composite of a gas impermeable fabric, which makes up the bottom 72 and the walls 61 of the air bag 58, and the gas permeable fabric described above, which makes up the top 63 of the air bag. The top 63 and walls 61 are stitched or otherwise joined at shadow lines 63'. The gas impermeable fabric is, for instance, a polymer-coated nylon. The low air loss air bag 59 allows the pressurization of the air bag 59 with a smaller flow of gas than is required to inflate air bags 58, which results in the possibility of maintaining sufficient pressure with just one blower 108 operating while using low air loss air bags 59.

Each air bag 58 (it should be understood throughout the specification that, when reference is made to an air bag 58, the air bag could also be an air bag 59 constructed in the low air loss conformation) is provided with a flanged nipple 70 sewn in place on the bottom 72 of the air bag 58 between a patch 74 and the bottom 72 of the air bag. Patch 74 is provided with a hole (not numbered) of the same dimension as the inside diameter of the flanged nipple 70, and flanged nipple 70 is held in place by the attachment of patch 74 to the bottom 72 of air bags 58 by stitching or other means around the external edge of the flange 71 of the flanged nipple 70. Each air bag 58 is mounted separately on the baseboards 46–52 by snapping the female snaps 62 in the flaps 60 of each of the air bags 58 over the male snaps 56 on the edges of the baseboards 46–52 or with the VELCRO tape 55 and hooks 57, or both. When so positioned, the flanged nipple 70 on the bottom inside 72 of the air bag 58 projects through the holes 64 in the baseboards 46–52 over which the air bags 58 are positioned. An 0-ring 68 is provided in a groove (not numbered) around each of the flanged nipples 70 to insure a relatively gas-tight fit between the flanged nipple 70 and the corresponding baseboard 46–52 through which the flanged nipples 70 project.

The use of individual air bags 58 rather than a single air cushion allows the replacement of individual bags should one develop a leak, need cleaning or otherwise need attention. When it is desired to remove an individual air bag 58 from its respective baseboard 46–52, the female snaps 62 at each end of the air bag 58 are disengaged from the male snaps 56 (or the VELCRO strips peeled away from each other) on the edges of baseboards 46–52, and the air bag 58 is removed by twisting flanged nipple 70 up and out of the hole 64 in the baseboard 46–52. Removal can even be accomplished while the patient is lying on the inflated air bags 58.

The above-described VELCRO tape 55 and hooks 57 may also be provided to secure air bags 58 in addition to, or in place of, snaps 56 and 62. For additional security in holding air bags 58 onto baseboards 46–52, and to help insure a gas-tight fit between flanged nipple 70 and the baseboard 46–52 through which it projects, spring clip 73 may be inserted through nipple 70 of air bag 58. To insert the nipple 70 into hole 64, the hoop portion 75 of spring clip 73 is squeezed (through the fabric of air bag 58), causing the flanges 77 on the ends of the shank portion 79 of spring clip 73 to move toward each other so that they can enter the hole 64. Once inserted through the hole 64, flanges 77 spring apart, and will not permit the removal of nipple 70 from hole 64 without again squeezing the hoop portion 75 of spring clip 73.

Referring to FIG. 6, there is shown an end view of a bed constructed according to the present invention. Brace 102 is secured to the cross beam 29 of sub-frame 27 by means of bolts 104. Blowers 108 are mounted to the brace 102 by means of bolts 110 through the mounting plates 112 which are integral with the blower housing 116. A gasket, piece of plywood or particle board (not shown), or other sound and vibration dampening material may be interposed between mounting plates 112 and brace 102. A strip of such material is inserted between brace 102 and cross beam 29, and is shown at reference numeral 69. The blowers 108 include integral permanent split capacitor electric motors 114. When motors 114 are activated, blowers 108 move air out of the blower housings 116, through the blower funnels 118 and up the blower hoses 120 to the air box funnels 122 and on into the air box 124 (see FIGS. 3 and 6). Blowers 108 receive air from filter box 96 through hoses 98. The filter box 96 is retained within frame 100 for ease in removal (see FIGS. 7 and 17). The second blower 108 is provided to increase the volume which may be delivered to the air bags 58, thereby increasing the air pressure within air bags 58. A cover (not shown) lined with sound absorbing material may also be provided to enclose blowers 108 and thereby reduce noise.

Figure 4:
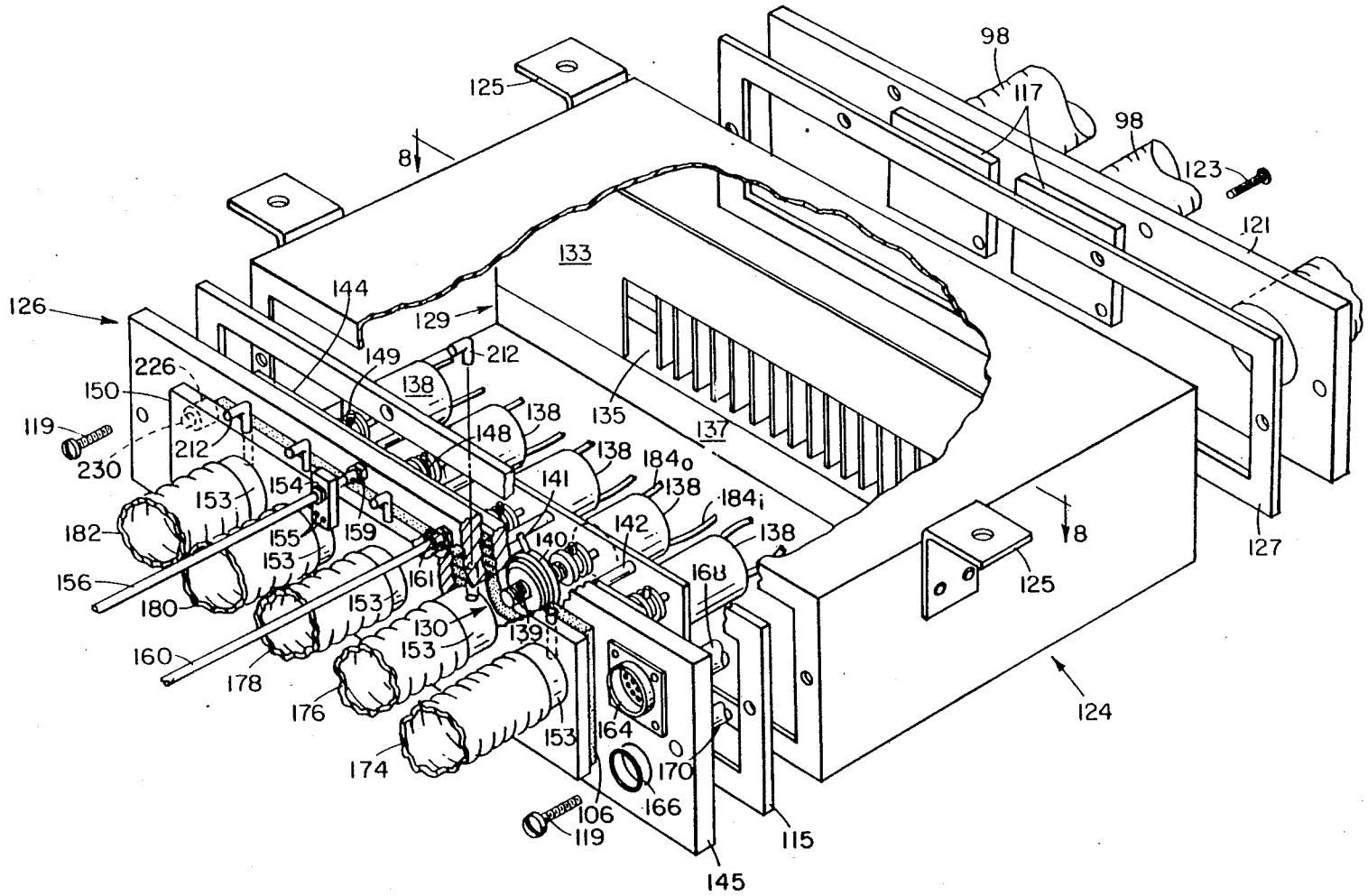
FIG. 4 is a perspective view of the air control box of the low air loss bed of FIG. 1 showing the cover in cutaway view to show the interior components of the air box.

The air control box 124 is an airtight box mounted on the underside of the baseboard 52 by brackets 125, and is shown in more detail in FIG. 4. Air box 124 is provided with a manifold assembly 126 held to the front of air box 124 by screws 119. Manifold assembly 126 is provided with a manifold plate 145 having holes (not numbered) therein for connection to a means for changing the amount of air supplied to the air bags 58 mounted to baseboards 46–52 in the region of the head, back, seat, leg, and feet respectively. Gasket 115 prevents the escape of air from between air box 124 and manifold plate 145. In a presently preferred embodiment, the means for changing the amount of air supplied to the air bags 58 takes the form of a plurality of valves, indicated generally at reference numerals 128–136. Each of the valves 128–136 is provided with a motor 138 having a nylon threaded shaft 139 (see FIGS. 4, 8, 9A and 9B) mounted on the drive shaft (not numbered) of each motor 138 and held in place by set screw 149 in collar 148. Plug 140 moves rotatably in and out along the threaded shaft 139 when limit pin 141 engages one or the other of the supports 142 which are immediately adjacent that particular plug 140 and which hold the motor mounting bracket 143 to the back of the full inflate plate 144.

Figure 9A:
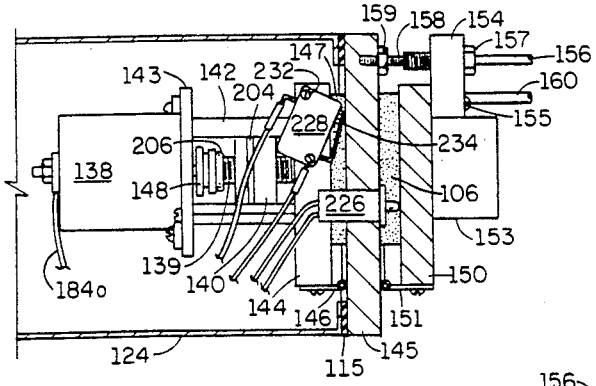
FIGS. 9A and 9B are cross-sectional views taken along the lines 9A—9A and 9B—9B, respectively, through the manifold assembly of the air box as shown in FIG. 8.
Figure 9B:
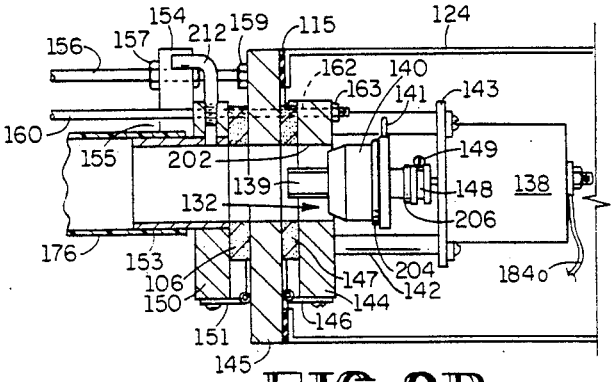

Full inflate plate 144 having openings 202 therein forming part of valves 128–136 is mounted to the back of the manifold plate 145 by hinges 146 (see FIGS. 9A and 9B). A gasket 147 is provided to prevent the escape of air from between the full inflate plate 144 and manifold plate 145. The motors 138 are not provided with limit switches, the movement of plug 140 back and forth along the threaded shaft 139 of each motor 138 being limited by engagement of plug 140 with the opening 202 as plug 140 moves forward and by the engagement of the back side of plug 140 with collar 148 as plug 140 moves back on threaded shaft 139. An O-ring 204 is provided on plug 140 which is compressed between plug 140 and opening 202 as plug 140 moves forward into opening 202. This compression continues until the load on motor 138 is sufficient to cause it to bind and stop. The 0-ring 206 which is provided on collar 148 operates in similar fashion when engaged by the back side of plug 140.

The binding of motors 138 by the loading of 0-rings 204 and 206 facilitates the reversal of the motors 138 and direction of travel of plug 140 along threaded shaft 139, because threaded shaft 139 is not bound. Threaded shaft 139 is free to reverse direction and turn such that the load created by the compression of O-rings 204 or 206 is released by the turning of threaded shaft 139, and plug 140 will rotate with threaded shaft 139 until limit pin 141 contacts support 142, stopping the rotation of plug 140 and causing it to move along shaft 139 as it continues to turn.

A dump plate 150 is mounted on the outside of manifold plate 145 by means of hinges 151 (see FIGS. 9A and 9B). A gasket 106 is provided to prevent the escape of air from between the manifold plate 145 and the dump plate 150. The dump plate 150 is provided with couplers 153, the interiors of which are continuous with the holes in manifold plate 145 when dump plate is in the position shown in FIGS. 9A and 9B, for connection of the appropriate bed frame gas supply hoses 174–182, as will be explained.

Block 154 is attached to dump plate 150 by means of screws 155, and serves as a point at which the cable 156 can be anchored, by means of nut 157, so that a line 158 can slide back and forth within cable 156 to allow the dump plate 150 to be selectively pivoted away from manifold plate 145 on hinge 151. The line 158 is secured to the manifold plate 145 by the threaded cable end and locknut 159. Line 158 is secured at its other end to the bracket 183 mounted on tube 190 (see FIG. 7). Bed frame 12 is provided with quick dump levers 165 on both sides thereof, the quick dump levers 165 being connected by tube 190 so that both levers 165 provide a remote control for operation of dump plate 150 by causing the movement of line 158 through cable 156. When either of quick dump levers 165 is moved from the position shown in FIG. 7, eccentric lever arm 181 pulls on line 158, cable 156 being anchored on bracket 183, so that line 158 moves through cable 156. The details of the anchoring of cable 156 and movement of line 158 therethrough under the influence of lever arm 181 are the same as those for the anchoring of cable 160' and movement of line 162' therethrough under the influence of lever arm 185' as shown in enlarged perspective view in FIG. 21. Movement of line 158 causes dump plate 150 to pivot away from manifold plate 145, allowing the air in air bags 58 to escape through manifolds 76–84 and bed frame gas supply hoses 174–182 to the atmosphere from the opening thus created between manifold plate 145 and dump plate 150 so that air bags 58 will rapidly deflate.

Figure 8:
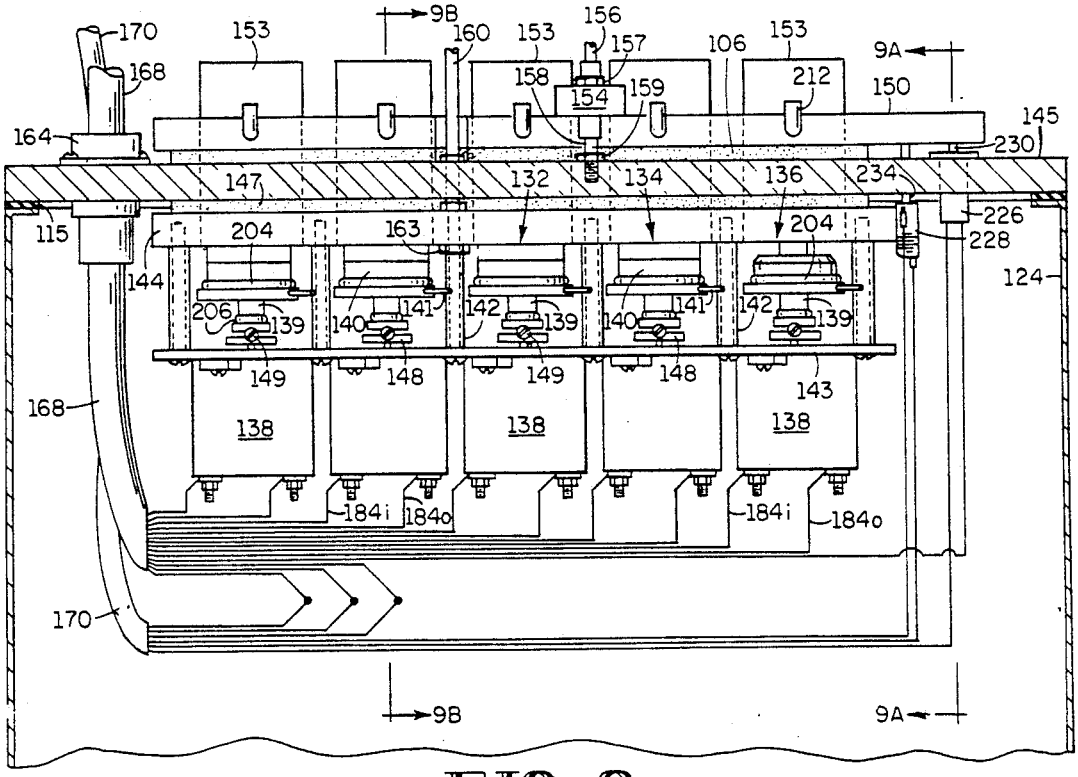
FIG. 8 is a sectional view of the air box of the low air loss bed of FIG. 1 taken along the lines 8—8 in FIG. 4.

As is best shown on FIGS. 8 and 9B, a separate cable 160 passes through manifold plate 145 in threaded fitting 161 so that line 162 can slide back and forth therein. The line 162 is anchored in the full inflate plate 144 by means of nut 163, which allows the full inflate plate 144 to pivot away from the manifold plate 145 on hinge 146. Pivoting of full inflate plate 144 away from manifold plate 145 in this manner removes full inflate plate 144, motor mounting bracket 143, and all other parts mounted to those parts, from the flow of air to allow the unrestricted entry of the air in air box 124 into the couplers 153 of valves 128–136 and on into bed frame gas supply hoses 174–182, resulting in the rapid and full inflation of air bags 58 to facilitate patient transfer or other needs. Line 162 is anchored at its other end on lever arm 185 (FIGS. 7, 17 and 21) which is attached to the bar 195 upon which full inflate knob 193 is mounted. A coil spring 201 is provided to protect line 162 as it is effectively wrapped around bar 195 when knob 193 is turned as will be described. Bed frame 12 is provided with full inflate knobs 193 on both sides thereof, the full inflate knobs 193 being connected by bar 195 so that both control the movement of line 162 through cable 160. Cable 160 is affixed to bracket 187 by threaded cable end 199, which is mounted on the DELRIN bearing 209 which is integral with support member 210 and which receives bar 195 so that rotation of full inflate knobs 193 causes line 162 to slide therein, pivoting full inflate plate 144 on hinge 146. The weight of motors 138, supports 142 and motor mounting bracket 143 bias full inflate plate 144 toward the position in which full inflate plate 144, motor mounting bracket 143, and the parts mounted thereto, are removed from the flow of gas into the couplers 153 of valves 128–136. This bias allows knobs 193 to act as a release such that they need only be turned enough to move the connection between line 162 and lever arm 185 out of its over center position, at which point gravity causes the plate 144 to open. When knobs 193 are returned to their initial position, lever arm 185 turns to the point at which the connection between line 162 and lever arm 185 is rotated past 180° from the point at which line 162 approaches bar 195, i.e., over center. The details of the anchoring of cable 160 and movement of line 162 therethrough under the influence of full inflate knobs 193 are the same as those shown in enlarged perspective view in FIG. 21 in connection with the explanation of the alternative embodiment of the present invention shown in that figure.

Air enters the air box 124 through air box funnel 122 in back plate 121 (FIG. 4). Air box funnel 122 is provided with a one-way flapper valve 117 so that air will not escape from the air box 124 when only one blower 108 is being operated. Back plate 121 is held in place on air box 124 by screws 123, and gasket 127 is provided to prevent the loss of air from between air box 124 and back plate 121.

Figure 14:
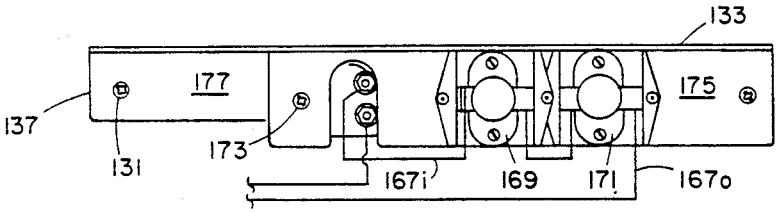
FIG. 14 is a top view of the heating element removed from the air box as shown in FIG. 4.
Figure 15:
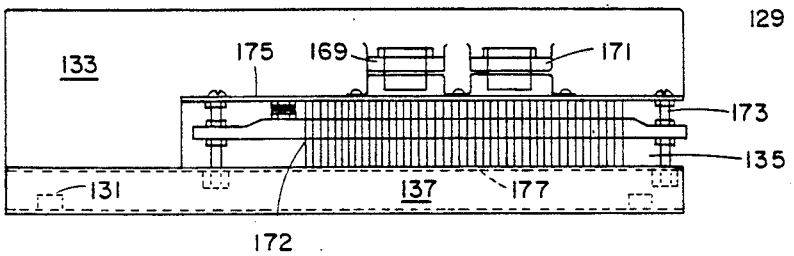
FIG. 15 is a side view of the heating element of FIG. 14.

The air box 124 is provided with a heating element indicated generally at 129 and shown in FIGS. 14 and 15. Screws 131 secure heating element 129 in place on the bottom of air box 124, effectively partitioning air box 124 into two compartments. Since air enters the air box 124 in one compartment (i.e., behind heating element 129) and leaves the air box 124 from the other compartment, a flow of air must pass through the space 135 between bulkhead 133 and the mounting bracket 137 of heating element 129, being mixed and heated as it does.

Wires $167_i$ and $167_o$ provide power to heating element 127, the wire $167_i$ connecting thermostats 169 and 171 and heater strip 172 in series. Heater strip 172 is suspended in space 135 by insulated posts 173 which are secured in the flanges 175 and 177 of bulkhead 133 and mounting bracket 137, respectively. Thermostat 169 switches off at 140° F., thermostat 171 switches off at 180° F., and heater strip 172 must cool to 120° F. for thermostat 169 to come back on. Thermostat 171 is merely redundant and included for safety purposes. Both thermostats 169 and 171 reset automatically, the thermostat 171 coming back on at 140° F.

Figure 3:
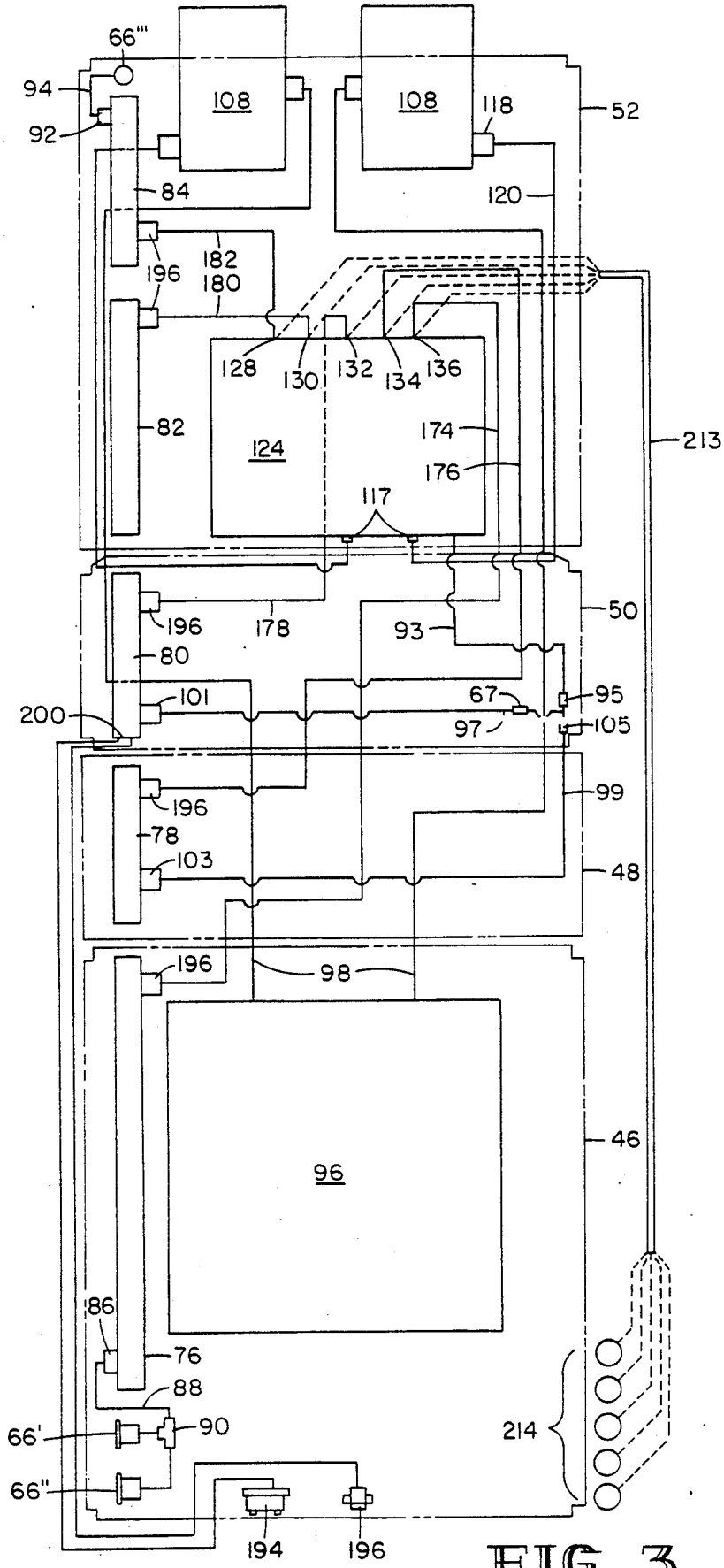
FIG. 3 is a schematic diagram of the air plumbing assembly of the low air loss bed of FIG. 1.

Referring to FIG. 3, the electric motors 114 of blowers 108 are switched on, forcing or pumping air (or other gases) received from filter box 96 through hoses 98 up the blower hoses 120, through one-way valves 117, and into air box 124. The air escapes from the air box 124 through valves 128–136 into the respective bed frame gas supply hoses, 174–182 (see FIG. 3). A separate bed frame gas supply hose is provided for the feet 174, legs 176, seat 178, back 180 and head 182, and each supplies a separate flow of gas to the manifolds 76–84. The feet baseboard 46, mounted on the section 14' of frame 12, is provided with a feet gas manifold 76. The leg 48 and seat 50 baseboards, and their corresponding frame sections 14'' and 14''', are provided with a leg gas manifold 78 and a seat gas manifold 80, respectively. The head baseboard 52, and its corresponding section 14'''', is provided with two separate gas manifolds, a back gas manifold 82 and a head gas manifold 84.

Because the feet baseboard 46 extends beyond the end member 16 of the frame 12 at the foot of the bed, a T-intersect 86 is provided from the feet gas manifold 76 to route feet extension hose 88 to the receptacles 66' and 66'' in the holes 64' and 64'' at the extreme ends of the feet baseboard 46 (see FIGS. 7 and 11). An extension hose T-intersect 90 is provided in the feet extension hose 88 to provide the connection to the hole 64'' in the feet baseboard 46. Clamps 65 are provided to hold the feet extension hose 88 in place on the receptacles 66' and 66'' and on T-intersect 86 as well as extension hose T-intersect 90. The head baseboard 52 likewise extends beyond the end member 16 of frame 12 at the head end of the bed (FIGS. 3 and 6), and T-intersect 92 is provided from the head gas manifold 84 to provide gas to the hole 64''' at the extreme end of the head baseboard 52 by means of the head extension hose 94. A clamp 65 is provided to retain head extension hose 94 on T-intersect 92 and on the receptacle 66''' (not shown).

Air enters the gas manifolds 76–84 through the funnels 196 from each respective bed frame gas supply hose 174–182 and then passes down the length of each gas manifold 76–84. Air escapes from the gas manifolds 76–84 into the air bags 58 through the holes 64, 64', 64'' and 64''' in the baseboards 46–52, thereby inflating the air bags 58 located above that particular gas manifold 76–84.

Because each of the bed frame gas supply hoses 174–182 is continuous with a corresponding gas manifold 76–84, the amount of air supplied to each gas manifold 76–82 can be varied using the valves 128–136 on the air box 124. Since each of the valves 128–136 controls the amount of air supplied to one of the manifolds 76–84, each valve 128–136 controls the amount of air supplied to the set of air bags 58 located directly above an individual gas manifold 76–84. Each of the valves 128–136 is opened and closed by the movement of plug 140 along threaded shaft 139 as motor 138 is activated in one direction or the other as described above under the control of switches 186 on pendent control 188. The motors 138 are brush-type DC control motors powered by current from the wires $184_i$ and $184_o$ under control of switches 186. Five of the switches 186 on pendent control 188 are double pole, double throw, three-position, spring return-to-center-off rocker switches, and are connected to motors 138 through electric cable 170, which plugs into the 14-pin connector 164 in manifold plate 145 (see FIG. 10). The sixth switch 186 is the main power switch, as will be explained, which is likewise connected through 14-pin connector 164 in manifold plate 145. A cradle 179 may be provided for mounting of pendent control 188 on head board 20, foot board 21, or side rails 81 and 87.

Color coding (not shown) of the control valve rocker switches 186 and the bed frame sections 14'–14'''' (i.e., section 14' is colored pastel purple and the switch 186 which operates valve 128 is colored pastel purple, section 14'' is colored pastel pink and the switch 186 which operates valve 130 is likewise colored pastel pink, etc.) may be provided to enable patients or health care personnel to correlate the individual valve to the particular set of air bags which it controls conveniently without having to read the labeling which may also be provided. The pastel colors are used for their aesthetic appearance. Also, the color coding is inexpensive and easily understood so that the bed can be quickly adjusted, and is universally used and recognized in innumerable instances.

As noted above, the frame 12 is hinged at 44', 44'' and 44''', allowing the baseboards 46 and 52 to be raised from the horizontal for the comfort of the patient or, perhaps, for therapeutic purposes. However, especially when head baseboard 52 is raised, the deviation from the horizontal places a disproportionate amount of the patient's weight on the air bags 58 over the legs 48 and seat 50 baseboards. In a presently preferred embodiment of the present invention, there are only three air bags mounted on each of the baseboards 48 and 50, such that a great proportion of the patient's weight, which is spread out over more than 20 of the air bags 58 when the sections 14', 14'', 14''' and 14'''' are all in the same horizontal plane, is concentrated onto as few as six of the air bags 58.

Figure 21:
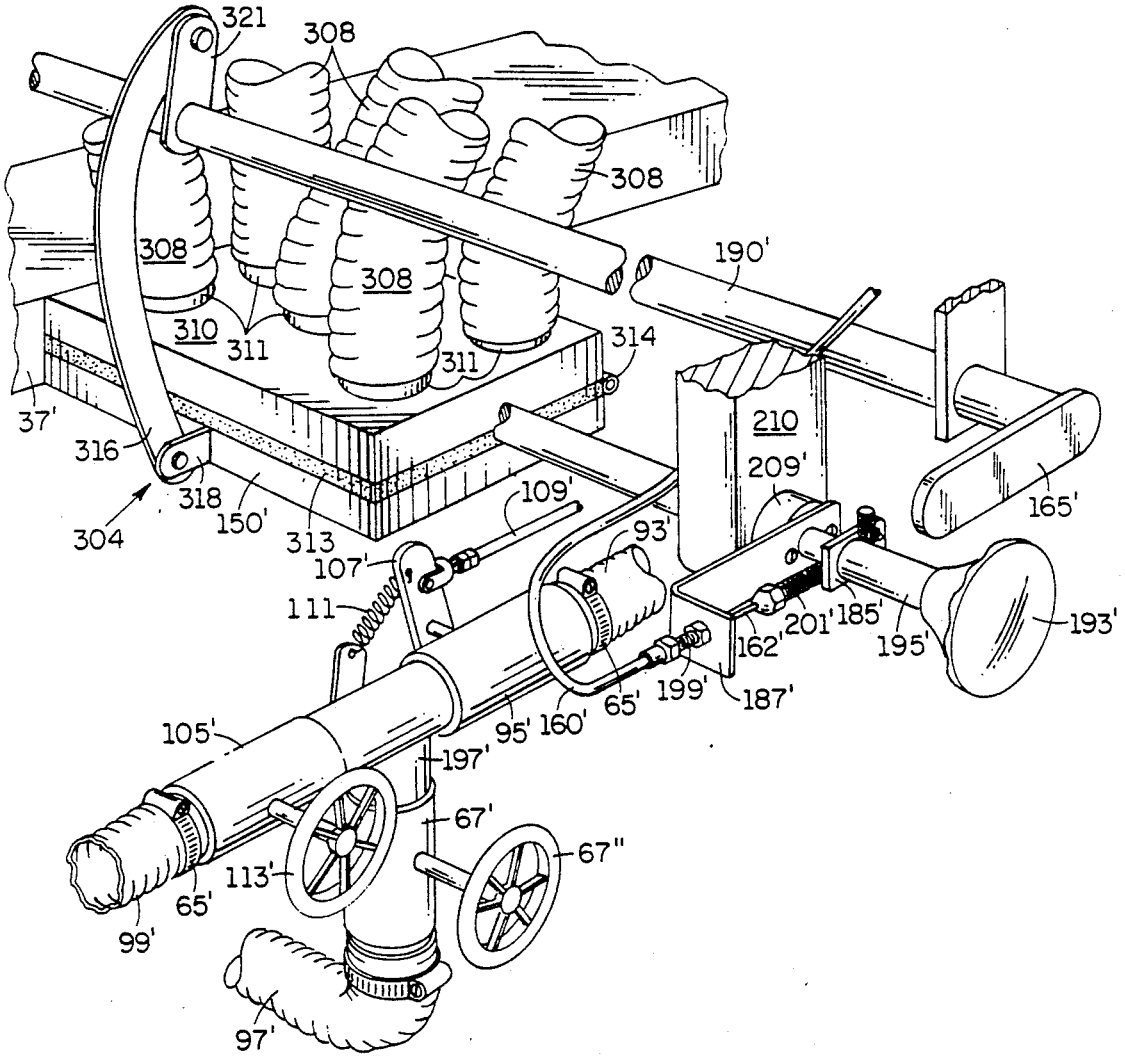
FIG. 21 is a perspective view of the quick dump and full inflate mechanisms of the alternative construction of the low air loss bed shown in FIG. 17 removed from beneath the bed and enlarged to show the details of the construction of these operating features.

To enable the air bags 58 mounted on the leg 48 and seat 50 baseboards to sustain this burden, the legs gas manifold 78 and seat gas manifold 80 may be provided with an additional flow of air from blowers 108. Referring to FIGS. 3 and 21, line 93' is attached to air box 124 and valve 95'. (FIG. 21 shows an alternative embodiment of the present invention. However, because the embodiment shown in FIG. 21 shows the same means for routing a flow of gas from the gas source to the set of air bags supporting the heavier portions of the patient as the embodiment shown in FIGS. 1–15, the same reference numerals are used, with the primed designation, to refer to those component parts.) Air proceeds from air box 124 through line 93' directly to valve 95' without passing through any of the valves 128–136 or bed frame gas supply hoses 174–182. Valve 95' is opened to allow air to pass into line 97'. A second valve 105' is located in line 93' which may be opened to allow air to pass into line 99'. In the presently preferred embodiment shown in FIG. 21, valve 95' is a two position valve which is either open or closed, and is operated by a pivotally attached lever arm 107' which is pivotally attached by cable 109' to the frame section 14' of the head baseboard 52 (not shown) so that when head baseboard 52 is raised from the horizontal, valve 95' is automatically opened allowing a flow of gas to enter line 97' through tee intersect 197'. The valve 95' returns to the closed position when head baseboard 52 is lowered due to the action of spring 111' anchored to tee 197'. Another valve 67' in tee intersect 197' is continuously adjustable by means of knob 67''. The second valve 105' is provided with a continuously adjustable knob 113' which may be set by the operator to allow as much additional air to pass into line 99' from line 93' as may be required, depending upon the weight of the patient, to support the patient's legs. The flow of additional air into the seat 80 and legs 78 (not shown in FIG. 21) gas manifolds provides the additional air pressure needed to provide the support which may be required for air bags 58 when the patient's weight is concentrated on that set of air bags 58 by any patient likely to be encountered. The air pressure in the air bags 58 over seat baseboard 50 or legs baseboard 48, or both, may also be fine-tuned by the use of valve 132 and/or valve 134.

Referring to FIGS. 3, 4, 6, 8, 9B, 16 and 19, air chucks 212 are provided in the dump plate 150 which communicate, in airtight sealing relationship, to the opening in each of the couplers 153 of valves 128–136. Using these air chucks 212 as a take off point for air pressure lines 213 and corresponding air pressure gauges 214 (see FIG. 12 and 13), the pressure in each sealed bed frame supply hose 174–182, and hence, in each set of air bags 58, can be checked and the appropriate valves 128–136 adjusted to give a desired air pressure in an individual set of air bags 58. Air pressure gauges 214 are mounted to cross bar 215, which is mounted by means of screws 216 to brackets 217. The brackets 217 are sized to allow the air pressure gauges 214 to be mounted to either the headboard 20 or foot board 21, by slipping over the board as shown in FIG. 1.

Figure 10:
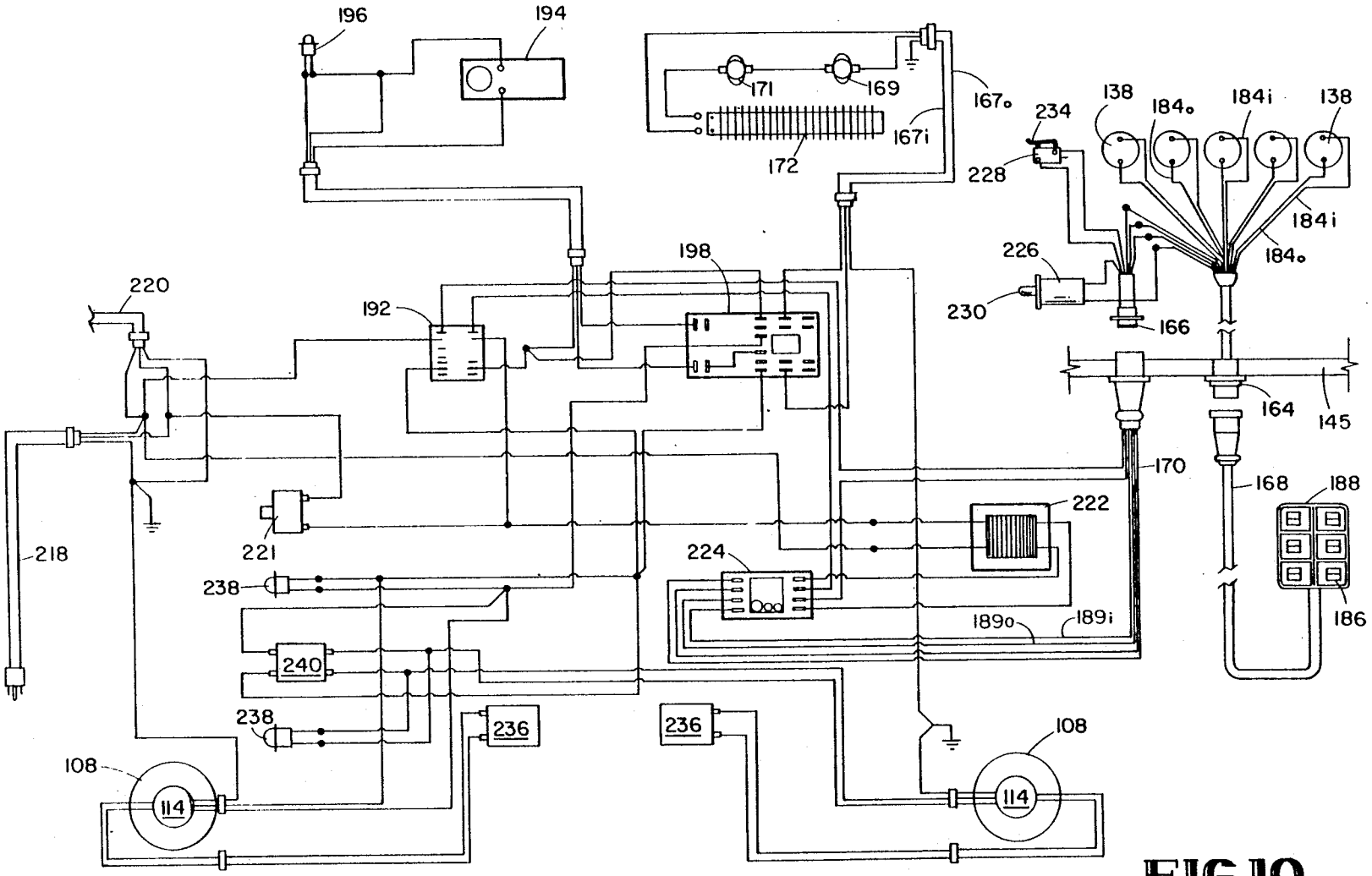
FIG. 10 is a schematic electrical diagram of the low air loss bed of FIG. 1.

Referring to FIG. 10, there is shown a schematic electrical diagram of the low air loss bed of the present invention. Alternating current enters the circuitry from electric cord 218, and is split to power the motors (not shown) for adjustment of the height and toe-to-toe angle of frame 12 through lead 220 as is known in the art. Current is also routed through current breaker 221 to transformer 222. The low voltage of the A.C. power from transformer 222 is regulated by voltage regulator 224, which provides D.C. current to motors 138 on the inside of air box 124 and the switches on pendent control 188 by wires $189_i$ and $189_o$, the electrical cable 170 passing through manifold plate 145 by means of 9-pin connector 166. Switch 186 on pendent control 188 is a two-position, maintain contact switch which activates the relay 192. Relay 192 activates the circuit containing thermostat 194 as well as the relay portion of time delay 198. Thermostat 194 includes a sensor 200 located in seat gas manifold 80, shown schematically in FIG. 3, and when the circuit containing thermostat 194 is closed due to the temperature of the air in seat gas manifold 80, the pilot light 196 comes on indicating that the circuit has been completed to the time delay portion of time delay 198. Thermostat 194 also includes a control 202 (see FIGS. 2, 7 and 17) for adjustment of the temperature of the gas in seat gas manifold 80, and a thermometer gauge 209 for continuous monitoring of that temperature. If this circuit stays completed for a predetermined period of time, the relay portion of time delay 198 is energized so that the circuit including wires $167_i$ and $167_o$ and heating element 172 is completed.

Relay 192 also activates the circuit which includes toggle switch 240, by which the operator may select one or both of the blowers 108. Pilot lights 238 and capacitors 236 are included in both circuits to the motors 114 of blowers 108.

Limit switches 226 and 228 are provided in manifold plate 145 and on full inflate plate 144, respectively (see FIGS. 4, 8 and 9A). Limit switch 226 is closed when push button 230 is engaged by dump plate. When push button 230 is disengaged by the movement of dump plate 150 away from manifold plate 145 under the influence of levers 165, the circuit is opened and blowers 108 are shut off. Limit switch 228 is affixed to full inflate plate 144 by screws 232, and the circuit is open when lever arm 234 engages manifold plate 145. When full inflate plate 144 is opened under the influence of full inflate knobs 193, limit switch 228 is closed, activating the buzzer which is incorporated into the voltage regulator 224.

Figures 16, 20:
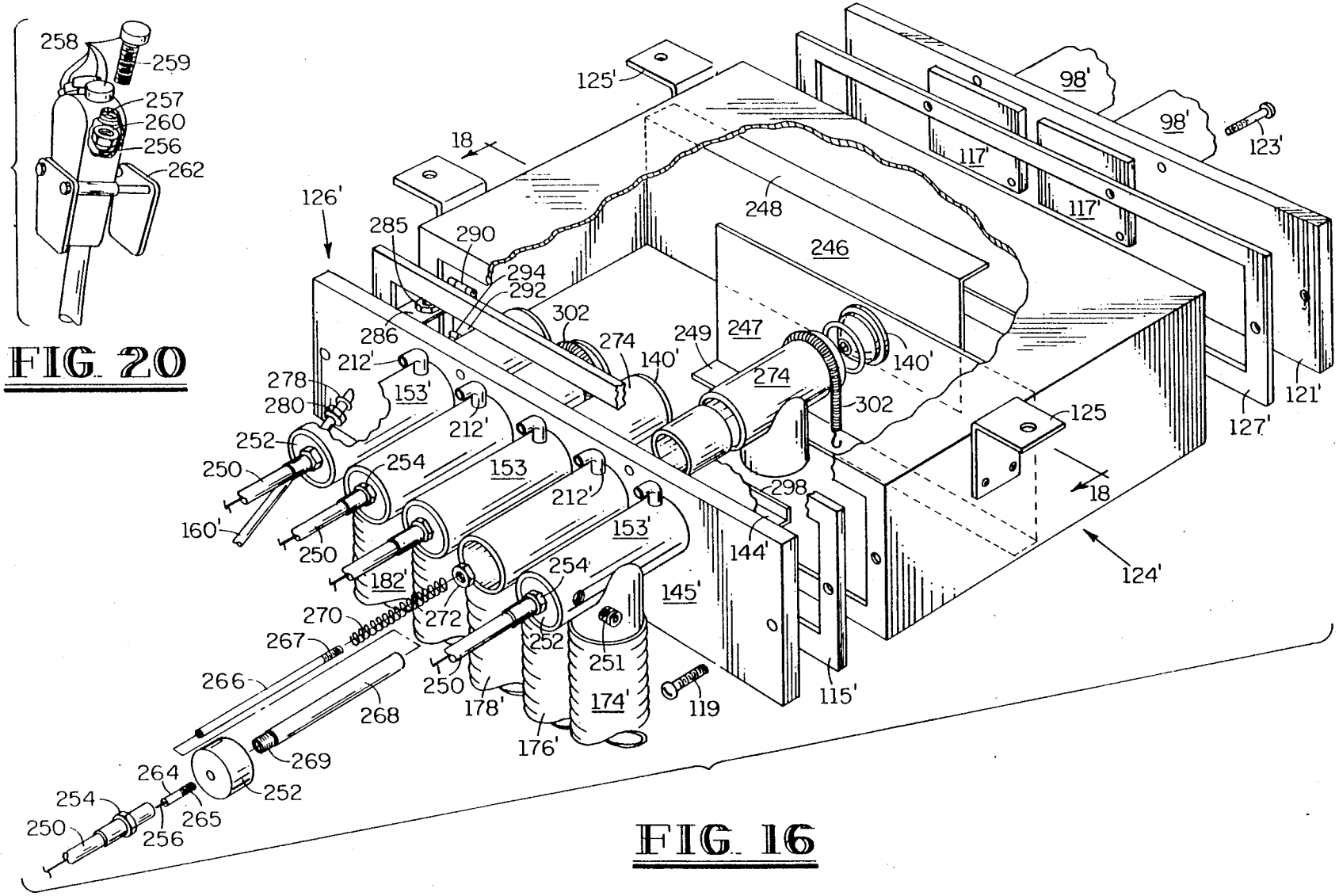
FIG. 16 is a perspective view of an alternative embodiment of the air control box of the low air loss bed of the present invention.
FIG. 20 is a perspective view of the pendent control for the air box of FIG. 16.

Referring to FIGS. 16–20, there is shown an alternative embodiment of the air box 124 and control system for the valves 128–136 in air box 124, in which those parts which correspond to the component parts shown in FIGS. 1–15 are shown with the primed designation of the same reference numerals used in FIGS. 1–15 to the extent possible. The air box 124' is shown in FIG. 16 with a manifold assembly 126', held onto air box 124' by screws 119' with gasket 115' therebetween. Air box 124' is held to the bottom of head baseboard 52' by means of mounting brackets 125'. Air from hoses 98' enters the air box 124' through one-way flapper valves 117' in back plate 121', and black plate 121' and gasket 127' are held to air box 124' by screws 123'. Air box 124' is shown with baffles 246 and 247 mounted to the inside of air box 124' by screws (not shown) through the flanges 248 and 249 respectively, to insure adequate mixing of the air inside the air box 124', but one or both of the baffles 246 or 247 could be replaced by a heating element (not shown) as discussed in connection with the description of FIGS. 1–15.

Manifold plate 145' is provided with couplers 153' which provide the point of connection for control cables 250 and bed frame gas supply hoses 174'–182'. Each control cable 250 is anchored in stopper 252 by collar 254. Stopper 252 is sized to fit tightly into couplers 153', the set screw 251 retaining it therein. Each line 256 slides back and forth within control cable 250 under the influence of its adjustment knob 258 in pendent control 188' as the adjustment knob 258 is moved in and out of threaded hole 257 on threads 259, carrying nut 260 and line 256 with it. Control pad 188' is provided with spring-loaded bracket 262 to allow it to be releasably hung on the head board 20' (not shown) or footboard 21' (FIG. 17).

Line 256 passes through stopper 252 and terminates on bit 264. The threads 265 of bit 264 are received by threads on the inside of air adjustment rod 266, and the threads 267 at the other end of air adjustment rod 266 are received by threads on the inside of plug 140', the collar 272 preventing any rotation therebetween. Air adjustment rod 266 is received within air adjustment tube 268 and spring 270, the air adjustment tube 268 and spring 270 being end-to-end around air adjustment rod 266. When line 256 is moved within control cable 250, that movement is transmitted through air adjustment rod 266 to plug 140', thereby opening or closing the respective tee of that valve 128'–136'. Spring 270 provides constant tension which movement of adjustment knob 258 must overcome to push plug 140' out of the opening of tee 274, insuring that plug 140' is always biased toward the opening in tee 274. The amount of constant tension can be adjusted by screwing air adjustment tube 268 into or out of the threads on the inside of stopper 252 which receive the threads 269 on air adjustment tube 268.

Figure 19:
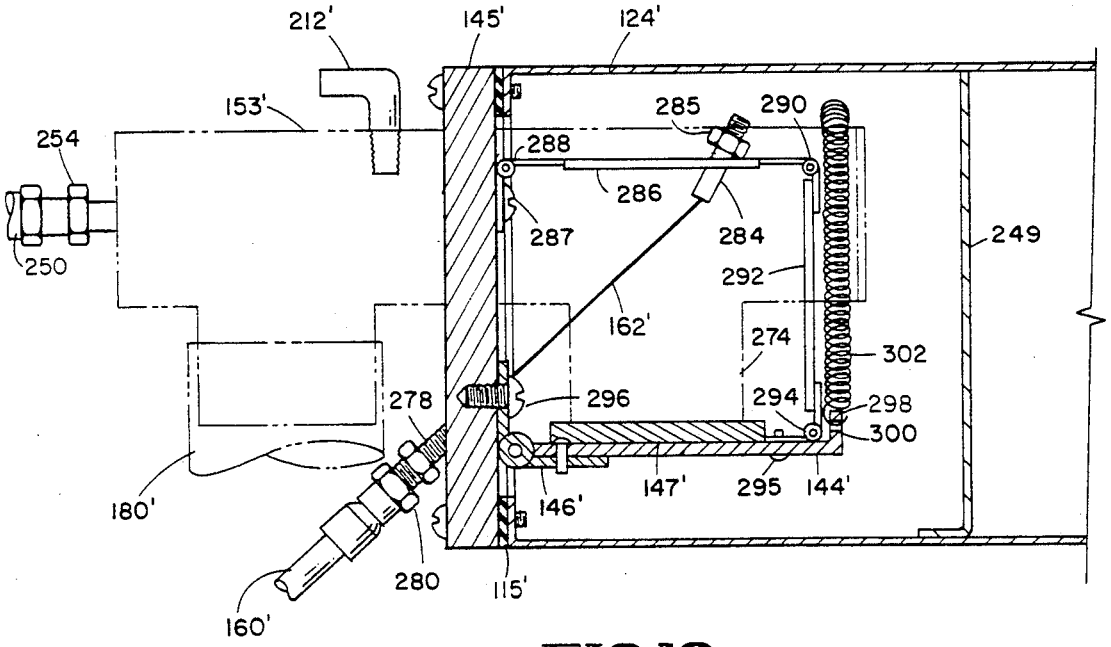
FIG. 19 is a cross-sectional view of the manifold assembly of FIG. 16 taken along the lines 19—19 in FIG. 18.

Like the embodiment shown in FIGS. 1–15, the embodiment of the present invention shown in FIGS. 16–20 is provided with a means for fully inflating the air bags 58' (not shown). Line 162' is anchored at one end on lever 185' which is attached to the DELRIN bearing 209 which is integral with support member 210' and which receives bar 195' upon which full inflate knobs 193' are mounted. Cable 160' is affixed to bracket 187' which is mounted on the support member 210' which receives bar 195' so that rotation of either of the knobs 193' will cause line 162' to slide therein. Referring to FIG. 19, in which the details of valves 134' and 136' are not shown and the inside tees 274 are shown only in shadow lines, cable 160' is anchored on its other end on fitting 278 in manifold plate 145' by nut 280. Line 162' passes through fitting 278 and is anchored in fitting 284 by nut 285 in horizontal member 286. Horizontal member 286 is secured on one end to the inside of manifold plate 145' by screw 287 through hinge 288 and on the other end to hinge 290. Hinge 290 is secured to one end of vertical member 292, which has a similar hinge 294 at the other end. The hinge 294 attaches to one side of full inflate plate 144' by rivets 295. Full inflate plate 144' is secured on its other side to manifold plate 145' by means of screw 296 through hinge 146'. Full inflate plate 144' is provided with a flange 298 having holes 300 therein spaced at intervals so as to receive the ends of coil springs 302 which wrap around the inside tees 274, holding full inflate plate 144' up tightly against the air intake to the inside tees 274 of valves 128'–136'. Gasket 147' is applied to full inflate plate 144' to insure an airtight fitting around the openings of inside tees 274 to valves 128'–136'. When line 162' moves through cable 160' when either of knobs 193' is rotated, horizontal member 286 is pulled downwardly, thereby pulling full inflate plate 144' downwardly by means of the connection provided by vertical member 292 and hinges 290 and 294. Returning knobs 193' to their original position allows the full inflate plate 144' to return to its original position by means of the upward force applied by coil springs 302. Operation of knobs 193' and full inflate plate 194' is the same as the operation of knobs 193 and full inflate plate 144' except that full inflate plate 144' is biased toward the position in which the flow of air through valves 128'–136' is blocked rather than away from that position, as is the case with full inflate plate 144'. Again, this bias allows knobs 193' to act as releases.

Rapid deflation of air bags 58 is provided by quick disconnect 304 (FIG. 21). A T-intersect 306 is provided in each of the bed frame gas supply hoses 174'–182' (see FIG. 17). A quick disconnect hose 308 connects each of the T-intersects 306 in each of the respective bed frame gas supply hoses 174'–182' to the quick disconnect 304 (FIG. 21). Quick disconnect 304 is provided with a receptacle plate 310 with five receptacles 311 to which the quick disconnect hoses 308 are attached, and dump plate 150' which is hinged to receptacle plate 310 by hinge 314. Gasket 313 is provided to help insure an air-tight seal between receptacle plate 310 and dump plate 150'. An eccentric, pivoted bell crank lever 316 is pivotally attached at one end to lever 321, and at the other end to a hinge 318 which is attached to dump plate 150'. Lever 321 is secured to the tube 190' which connects the two quick disconnect levers 165' so that rotation of either of the quick dump levers 165' has the result of pivoting dump plate 150' downwardly away from receptacle plate 310 so that air can escape to the atmosphere from each of the bed frame gas supply hoses 174'–182'.

Although the present invention has been described in terms of the foregoing preferred embodiments, this description has been provided by way of explanation only and is not to be construed as a limitation of the invention, the scope of which is limited only by the following claims.

I claim:

1. A patient support apparatus for supporting a patient thereon comprising:

a source of gas;

a plurality of sets of air bags for supporting a patient thereon, each of said sets of air bags being mounted to a bed frame;

a plurality of sets of gas manifolds, each manifold of said sets of gas manifolds communicating separately with said gas source and with the interior of the air bags of one set of said sets of air bags;

an air control box between said gas source and said gas manifolds; and a plate pivotally mounted to said air control box having a plurality of openings therethrough, each of the openings being connectible to a gas supply hose for directing a flow of gas from said air control box to one of said gas manifolds, said plate being selectively pivotable to open the openings to the atmosphere, allowing the gas to escape from said air bags, collapsing said air bags and causing the patient to be supported by a rigid portion of bed frame.

2. The patient support apparatus of claim 1 wherein said apparatus is a low air loss patient support apparatus and said plate is provided with a switch operable to shut off the flow of gas from said gas source when said plate is pivoted on said hinge to allow said openings to communicate with the atmosphere.

3. The patient support apparatus of claim 1 wherein said apparatus is a low air loss patient support apparatus and the flow of air passing through each of the openings in said plate is adjusted by selective operation of power means having means mounted thereto for opening and closing each of the openings.

4. The patient support apparatus of claim 3 further comprising means for simultaneously fully opening the openings said plate, thereby fully inflating said air bags.

5. The patient support apparatus of claim 1 wherein said apparatus is a low air loss patient support apparatus and the flow of air passing through each of the openings in the said plate is adjusted by selectively operating a plurality of individually adjustable cables, each cable having means mounted thereon for opening and closing each of the openings.

6. The patient support apparatus of claim 1 wherein said apparatus is a low air loss patient support apparatus and said gas source comprises two blowers.

7. The patient support apparatus of claim 6 wherein said blowers are connected to said air control box by separate hoses, each of said hoses having a one-way valve therein operable to prevent the flow of gas out of said air control box, thereby allowing the operation of said low air loss bed on either or both of said blowers.

8. The patient support apparatus of claim 1 wherein said apparatus is a low air loss patient support apparatus and said apparatus is a low air loss patient support apparatus and said air control box is provided with means for selectively routing a flow of gas from said gas source to a set of air bags supporting the heavier portions of the patient without passing through openings in said plate.

9. The patient support apparatus of claim 1 wherein:

said apparatus is a low air loss patient support apparatus; and said means for opening openings in said plate further comprises a plurality of individual gas supply hoses for directing a flow of gas from said air control box to one of said gas manifolds and has means therein communicating with a quick disconnect, said quick disconnect having a plate hingedly mounted thereto; said plate being pivotable between a first position sealing said quick disconnect and a second position in which gas can escape through said quick disconnect to the atmosphere.

10. A low air loss patient support apparatus for supporting a patient thereon comprising:

a source of gas;

a plurality of sets of air bags for supporting a patient thereon, each of said sets of air bags being mounted to a frame;

a plurality of gas manifolds, each of said gas manifolds communicating separately with said gas source and with the interior of the air bags of one set of said sets of air bags;

an air control box interposed between said gas source and said gas manifolds having a plurality of individually adjustable valves therein for selecting a controlled flow of gas from said gas source to each set of said sets of air bags; and control means for simultaneously fully inflating said air bags by effectively opening all of said valves and, subsequently, effectively closing said valves to return to said controlled gas flow.

11. The low air loss bed of claim 10 wherein each of said valves is adjusted by selective operation of power means having means mounted thereto for adjusting said valves.

12. The low air loss bed of claim 11 further comprising means for signaling the operator when said valve opening and closing means is removed from said flow of gas.

13. The low air loss bed of claim 10 further comprising a plurality of cables, each cable having means counted thereon for individually adjusting said valves.

14. The low air loss bed of claim 10 wherein said control means comprises a plate mounted to the inside of said air control box on a hinge, said plate having a plurality of openings therethrough communicating with said valves, each of the openings being provided with means for opening and closing said valves, said plate being selectively pivotable to a position in which said valve opening and closing means is removed from said flow of gas.

15. The low air loss bed of claim 14 wherein said plate is biased wither toward or away from said position in which said valve opening and closing means is removed from said flow of gas.

16. The low air loss bed of claim 14 wherein said plate is held in communication with said valves by a cable attached to said plate at one end and to an eccentrically mounted lever at the other end.

17. A low loss bed for supporting a patient thereon comprising:

a source of gas;

a plurality of sets of air bags mounted to a bed frame for supporting a patient thereon;

a plurality of gas manifolds, each of said gas manifolds communicating separately with said gas source and with the interior of the air bags of one set of said sets of air bags;

an air control box between said gas source and said gas manifolds and having means therein for separately changing the amount of gas delivered by said gas source to each of said gas manifolds;

means in said air control box for separating said air control box into two compartments, the gas entering said control box from said gas source in one compartment and leaving said air control box from the other compartment through said means for changing the amount of gas delivered to each of said gas manifolds and having means for heating the gas flowing therethrough mounted therein;

a sensor in one of said gas manifolds operably connected to a thermostat for selectively sensing and controlling said heating means; and means for switching said heating means on and off in response to the temperature inside the gas manifold having said sensor therein.

18. A method of lowering a patient supported on the air bags of a low air loss bed to the frame of the bed comprising:

supporting a patient on a plurality of air bags mounted on the frame of a low air loss bed with a flow of gas delivered to the air bags;

passing the gas delivered to the air bags through an air box;

passing the gas out of a plurality of openings in a plate hingedly mounted in the air box, each of the openings passing gas to a separate set of air bags; and selectively pivoting the plate to open the openings to the atmosphere, allowing the gas to simultaneously escape from each set of air bags to the atmosphere, thereby collapsing the air bags and causing the patient to be lowered onto the frame of the low air loss bed.

19. The method of claim 18 wherein the gas passing through the air box is supplied by a blower.

20. The method of claim 19 additionally comprising shutting off the blower when the plate is pivoted to open the openings therein to the atmosphere.

21. A method of simultaneously fully inflating the air bags of a low air loss bed from a partially inflated condition comprising:

supplying gas to a plurality of sets of air bags;

passing the gas supplied to the sets of air bags through an air box;

passing the gas out of the air box through a plurality of openings in a plate hingedly mounted to the air box, each of the openings passing gas to a separate set of air bags and each of the openings having means mounted therein for controlling the flow of gas therethrough to maintain a desired air pressure in the air bags while supporting a patient thereon; and selectively pivoting the plate to remove the openings in the plate from the flow of gas passing through the air box, thereby simultaneously fully inflating each of the air bags of the sets of air bags.

22. The method of claim 21 further comprising biasing the plate toward the position in which the openings therein are removed from the flow of gas passing through the air box.

23. A patient support system comprising:

a bed frame having a source of gas mounted thereto;

a plurality of sets of air bags for supporting a patient thereon, each of said sets of air bags being mounted to said frame;

a plurality of sets of one or more gas manifolds, each manifold of said sets of gas manifolds communicating separately with the interior of the air bags of one of said sets of air bags;

an air control box mounted on said bed frame for receiving gas from said source of gas and supplying gas to said gas manifolds through a plurality of separate openings;

means mounted on said air control box for dumping said gas from said air bags to the atmosphere to facilitate emergency cardiac arrest procedures performed on the patient supported on said air bags;

means for changing the amount of gas supplied by said gas source through each of said openings wherein said air supply changing means comprises a plurality of valves and power means for opening and closing said valves; and means for simultaneously fully opening each of said openings, thereby fully inflating said air bags.

24. The apparatus of claim 23 additionally comprising means for shutting off said air supply source from said openings when said gas dumping means is actuated.

25. A method of controlling the temperature of the air supplied to the air bags of a low air loss patient support system comprising:

supplying a flow of air to a low air loss patient support system;

passing the flow of air into an air box having a back compartment for receiving the flow of air and a front compartment having a plurality of valves therein for distribution of the flow of air;

passing the flow of the air from the back compartment of the air box to the front compartment of the air box through a bulkhead dividing the air box into the front and back compartments and having means mounted therein for changing the temperature of the air passing therethrough;

separately routing the flow of gas from the valves to a plurality of gas manifolds, each manifold communicating separately with the interior of a set of air bags;

sensing the temperature of the air in one of the manifolds; and switching the air temperature changing means on or off in response to the temperature in the gas manifold in which the temperature is sensed.

26. A low air loss patient support apparatus comprising:

a bed frame;

an air supply source mounted to said bed frame;

a plurality of inflatable air bags mounted to said bed frame and connected to said air supply source for supporting a patient thereon when inflated;

means connected between said air supply source and said air bags for controlling a flow of air from said air supply source to said air bags between lower and upper limits, for ensuring low interface pressures for the patient supported thereon; and control means for sequentially first increasing said flow of air to a higher rate sufficiently above said controlled rate to simultaneously fully inflate said air bags and for, then, returning said flow of air to said controlled rate to again provide low interface pressures for the patient supported on said air bags.

27. The patient support apparatus of claim 26 wherein:

said flow controlling means is adapted for separately controlling said flow of air from said air supply source to separate groups of said air bags at separately controlled rates for ensuring low interface pressures for each portion of the body of the patient supported on said air bags; and said flow increasing and returning means is adapted to return said flow of air from the higher rate to each of said separately controlled rates to again provide the low interface pressures for each portion of the body of the patient after increasing said flow of air to the higher rate.

28. The patient support apparatus of claim 26, further comprising: an air supply mounted to said air frame; a plurality of inflatable bags mounted to said frame and connected to said air supply source for supporting a patient thereon when inflated; and means for routing a flow of air from said air supply source to the air bags supporting certain portions of the patient supported thereon when weight of the patient is concentrated on the air bags supporting said certain portions of the patient.

29. The patient support apparatus of claim 26, wherein: said higher rate is above said upper limit.

30. A low air loss patient support apparatus comprising:

a plurality of inflatable air bags mounted on a bed frame and connected to an air supply source for supporting a patient when inflated; and an air control box connected between said air supply source and said air bags, said air control box having individually adjustable valves therein for separately changing the amount of air delivered to separate groups of said air bags, said valves being mounted in a plate pivotally mounted to said air control box, said plate being pivoted to open said valves to the atmosphere to quickly deflate said air bags.

31. The apparatus of claim 30 wherein said plate contacts a switch for turning off said air supply source when said plate is pivoted to open said valves to the atmosphere.

32. A air loss patient support apparatus comprising:

a bed frame having an air supply source mounted on said frame, the air from said air supply source being delivered into a plurality of separate gas manifolds;

a plurality of inflatable air bags mounted on said frame and connected to said air supply source for supporting a patient thereon, each of said manifolds communicating with a plurality of said air bags;

an air control box interposed between said air supply source and said air bags having a plurality of valves therein for separately controlling the flow of air delivered to each of said gas manifolds to supply said flow of air to said air bags at a controlled rate, between lower and upper limits, thereby controlling the air pressure in the air bags connected to each of said manifolds; and control means for sequentially first increasing said flow of air to a higher rate sufficiently above said controlled rate to simultaneously fully inflate said air bags and for, then, returning said flow of air to said controlled rate.

33. The apparatus of claim 32 additionally comprising means for opening the valves of said air control box to the atmosphere and turning off said air supply source to quickly deflate said air bags.

34. A patient support apparatus comprising:

a plurality of inflatable air bags mounted on a bed frame and connected to an air supply source for supporting a patient thereon;

means for adjusting the air pressure in said air bags between lower and upper limits to provide a controlled pressure in said air bags for reducing patient interface pressures; and control means for sequentially fully inflating said air bags to a higher pressure above the upper limit and then returning said air bags to said controlled pressure.

35. The apparatus of claim 34 wherein said patient support apparatus is a low air loss patient support apparatus and the air from said air supply source is delivered into a plurality of separate gas manifolds, each of said manifolds communicating with a plurality of said air bags, for adjusting the interface pressure under separate portions of the body of the patient.

36. The apparatus of claim 35 wherein said air pressure adjusting means comprises a plurality of valves and means for opening said valves to the atmosphere and turning off said air supply source to quickly deflate said air bags to lower the patient onto said bed frame.

37. A low air loss bed for supporting a patient thereon comprising:

a source of gas;

a plurality of sets of air bags for supporting a patient thereon, each of said sets of air bags being mounted to a bed frame;

a plurality of gas manifolds, each of said gas manifolds communicating separately with said gas source and with the interior of the air bags of one set of said sets of air bags;

an air control box interposed between said gas source and said gas manifolds having a plurality of individually adjustable valves therein for changing the amount of gas flowing from said gas source to each set of said sets of air bags; and a plate mounted to the inside of said air control box on a hinge, said plate having a plurality of openings therethrough communicating with said valves, each of the openings being provided with means for opening and closing said valves, said plate being selectively pivotable to a position in which said valve opening and closing means is removed from said flow of gas to simultaneously fully inflate said air bags.

38. The low air loss bed of claim 37 wherein said plate is biased either toward or away from said position in which said valve opening and closing means is removed from said flow of gas.

39. The low air loss bed of claim 37 wherein said plate is held in communication with said valves by a cable attached to said plate at one end and to an eccentrically mounted lever at the other end.

* * * * *